US012486684B2

(12) United States Patent
Schofield et al.

(10) Patent No.: US 12,486,684 B2
(45) Date of Patent: Dec. 2, 2025

(54) RAPID WALL BUILDING SYSTEM AND METHOD

(71) Applicant: Schofield Technologies, Inc., Dearborn, MI (US)

(72) Inventors: William J. Schofield, Dearborn, MI (US); Gerard J. Kmita, Allen Park, MI (US); Daniel Scott Cannon, Royal Oak, MI (US); Jeremy Masser, Linden, MI (US)

(73) Assignee: Schofield Technologies, Inc., Dearborn, MI (US)

( * ) Notice: Subject to any disclaimer, the term of this patent is extended or adjusted under 35 U.S.C. 154(b) by 204 days.

(21) Appl. No.: 18/559,604

(22) PCT Filed: May 12, 2022

(86) PCT No.: PCT/US2022/028896
§ 371 (c)(1),
(2) Date: Nov. 8, 2023

(87) PCT Pub. No.: WO2022/241063
PCT Pub. Date: Nov. 17, 2022

(65) Prior Publication Data

US 2024/0254789 A1 Aug. 1, 2024

Related U.S. Application Data

(60) Provisional application No. 63/340,537, filed on May 11, 2022, provisional application No. 63/316,386, (Continued)

(51) Int. Cl.
*E04H 1/12* (2006.01)
*E04B 1/19* (2006.01)
*E04B 1/343* (2006.01)

(52) U.S. Cl.
CPC ..... *E04H 1/1205* (2013.01); *E04B 1/1903* (2013.01); *E04B 1/34321* (2013.01)

(58) Field of Classification Search
CPC .. E04H 1/1205; E04B 1/1903; E04B 1/34321
See application file for complete search history.

(56) References Cited

U.S. PATENT DOCUMENTS 4,090,339 A 5/1978 Anderson
6,298,619 B1 10/2001 Davie
(Continued)

OTHER PUBLICATIONS

International Search Report and Written Opinion for an International Application No. PCT/US22/28896, dated Aug. 16, 2022.

*Primary Examiner* — Rodney Mintz
(74) *Attorney, Agent, or Firm* — Quinn IP Law

(57) ABSTRACT

A lightweight modular shelter, and method for assembling a shelter. The shelter includes first and second panels and first and second panel connectors. The panel connectors have a panel edge channel operatively connected to sides of the first and second panels, and have a connector plug and a connector socket. The connector plug of the first panel connector is inserted into the connector socket of the second panel connector, such that the first panel and the second panel are operatively connected. The shelter may also include a bottom track, where the first panel, the second panel, the first panel connector, and the second panel connector are mated to the bottom track. Methods include attaching the panels and connectors, along with corner connectors, to the bottom track to form a freestanding structure. Roof panels and connectors and gable panels and connectors may be attached thereto.

16 Claims, 15 Drawing Sheets

Related U.S. Application Data filed on Mar. 3, 2022, provisional application No. 63/223,779, filed on Jul. 20, 2021, provisional application No. 63/208,949, filed on Jun. 9, 2021, provisional application No. 63/187,438, filed on May 12, 2021.

(56) References Cited

U.S. PATENT DOCUMENTS

| | | | | |
|---|---|---|---|---|
| 7,021,014 | B1 | 4/2006 | Wolfe | |
| 8,136,324 | B2 * | 3/2012 | Browning | E04B 1/14 52/582.1 |
| 8,156,690 | B2 * | 4/2012 | Higley | E04B 1/12 52/79.5 |
| 8,397,461 | B2 * | 3/2013 | Browning | E04B 1/14 52/592.2 |
| 8,561,358 | B2 * | 10/2013 | Rowan | E04H 1/1205 52/79.1 |
| 8,776,449 | B1 * | 7/2014 | Rowan | E04H 1/1205 52/79.1 |
| 10,221,568 | B2 * | 3/2019 | Ljubicic Rubio | H01R 24/66 |
| D977,680 | S * | 2/2023 | Schofield | E04B 1/0046 D25/56 |
| D978,380 | S * | 2/2023 | Schofield | E04B 1/5818 D25/199 |
| D1,051,431 | S * | 11/2024 | Schofield | D25/124 |
| D1,051,432 | S * | 11/2024 | Schofield | D25/124 |
| D1,082,057 | S * | 7/2025 | Schofield | D25/124 |
| 2008/0047217 | A1 * | 2/2008 | Browning | E04B 1/14 52/576 |
| 2011/0126487 | A1 * | 6/2011 | Browning | E04B 1/14 52/586.1 |
| 2011/0162292 | A1 | 7/2011 | Higley | |
| 2011/0209735 | A1 * | 9/2011 | Rowan | E04B 1/34315 135/96 |
| 2016/0222645 | A1 * | 8/2016 | Fay | E04B 7/12 |
| 2016/0305123 | A1 * | 10/2016 | Ljubicic Rubio | H01R 24/76 |
| 2022/0220724 | A1 * | 7/2022 | Schofield | E04B 1/5818 |
| 2023/0064004 | A1 * | 3/2023 | Hoffman | E04H 1/02 |
| 2024/0309632 | A1 * | 9/2024 | Schofield | E04B 1/6116 |

* cited by examiner

RAPID WALL BUILDING SYSTEM AND METHOD

CROSS-REFERENCE TO RELATED APPLICATIONS

This application claims the benefit of U.S. Provisional Application No. 63/208,949, filed Jun. 9, 2021: U.S. Provisional Application No. 63/187,438, filed May 12, 2021: U.S. Provisional Application No. 63/316,386, filed Mar. 3, 2022: U.S. application Ser. No. 29/834,548, filed Apr. 12, 2022: U.S. application Ser. No. 29/787,993, filed Jun. 9, 2021; U.S. application Ser. No. 29/787,996, filed Jun. 9, 2021: U.S. application Ser. No. 29/787,999, filed Jun. 9, 2021: U.S. Provisional Application No. 63/223,779, filed Jul. 20, 2021: U.S. Provisional Application No. 63/340,537, filed May 11, 2022: all of which are hereby incorporated by reference in their entirety.

TECHNICAL FIELD

The present disclosure pertains to a modular shelter structure and method for constructing a modular shelter. More specifically, the disclosure provides a lightweight modular substantially rigid wall system for use in the areas of construction of temporary shelters, storage units, property demarcation, emergency facilities, agricultural facilities, and similar facilities for the military, humanitarian purposes, industrial, recreation, and municipal purposes.

BACKGROUND

Existing shelter solutions for utilitarian purposes, including tent-type structures, may be configured as short-term solutions, for example, which do not provide the durability, adaptability, security and protection required for the utilitarian purpose. Durable, longer-term shelters can be cost prohibitive and/or require materials, tools, and/or skills which are not available at or readily transportable to the geographic area where the shelter solution is needed. Further, durable, longer-term shelters may be constructed such that they cannot be disassembled for reuse and/or relocation, for example, from one geographic area to another.

Standard methods for the sheltering and storage of people and goods are typically contained within two primary groupings: (1) Soft Wall Structures (tents and the like), and (2) Rigid Wall Structures (shipping containers, framed walls, prefabricated structures, and the like). Each of these solutions solves a problem but introduces a multitude of other problems during their use. Tents and soft sided tarp and canvas structures deteriorate in the elements, provide no, or limited, structural capacity, have essentially no thermal efficiency, are typically ground based (direct contact with the ground), and must be replaced frequently to remain even the least bit effective for providing coverage to people, goods, and/or supplies.

Rigid structures may solve the problems of thermal efficiency and structural capacity, but are currently heavy to move and assemble, are expensive and more complex than a tent to assemble. Additionally, rigid structures are fixed use—i.e., once in place they will stay in place—typically require equipment and power to assemble and are not conducive to rapid deployment in areas without ease of accessibility, power, or a skilled workforce capable of lifting, maneuvering, and assembling these heavy rigid structures.

SUMMARY

A lightweight modular shelter, and method for assembling a modular shelter, are provided. The shelter includes a first panel and a first panel connector, which has a panel edge channel operatively connected to a side of the first panel, and a connector plug and a connector socket. The shelter includes second panel and a second panel connector, which has a panel edge channel operatively connected to a side of the second panel, and a connector plug and a connector socket. The connector plug of the first panel connector is inserted into the connector socket of the second panel connector, such that the first panel and the second panel are operatively connected. The lightweight modular shelter may also include a bottom track. The first panel, the second panel, the first panel connector, and the second panel connector are mated to the bottom track.

The method of assembling the shelter includes laying a plurality of bottom tracks on a substantially flat surface: connecting a plurality of wall panel connectors to a plurality of wall panels via panel edge channels in the wall panel connectors; and connecting a plurality of corner connectors to the bottom tracks. The wall panel connectors and the plurality of wall panels are connected to the bottom tracks: the adjacent wall panel connectors are connected by inserting a connector plug of one wall panel connector into a connector socket of another wall panel connector; and the wall panel connectors are connected to one of the corner connectors by inserting the connector plug of one wall panel connector into a connector socket of the corner connector and by inserting a connector plug of the corner connector into the connector socket another wall panel connector. Therefore, the wall panels, the wall panel connectors, the corner connectors, and the bottom tracks form a freestanding structure having at least four wall assemblies.

The rigid wall modular system disclosed herein can be referred to as a Rapid Wall Building System (RWBS), using RWBS components and methods for constructing lightweight modular shelters from reusable standardized components assembled together such that the shelter can be quickly erected and when required, rapidly disassembled for relocation and/or redeployment. The components are lightweight and sized such that they are readily transportable. No special tools or skills are required to assemble the shelter, such that the shelter can be constructed, for example, by the persons deploying and/or requiring use of the shelter, with minimal or no training of the persons.

The Rapid Wall Building System and methods described herein can be used for constructing shelters for a broad range of utilitarian purposes, including military deployment and use, where the term shelter, as used herein, is intended to be interpreted broadly to include structures which are configured to house, store, secure and/or shelter living beings and/or non-living objects including, for example, persons, animals, equipment, vehicles and transportation equipment, medical equipment and supplies, communication equipment, artillery and ammunition, humanitarian supplies including food and agricultural supplies, etc.

As illustrated by the figures and drawings, the shelter components can be assembled into a plurality of different shelter configurations. One or more shelters have an initial configuration can be easily disassembled and the disassembled components can be recombined and reassembled into one or more shelters of the same or a different configuration.

Advantages and benefits of the RWBS system and method of constructing a rigid wall structure are illustrated by the figures and description. The advantages and benefits include, by way of non-limiting example: fewer and standardized components with easy, ergonomically favorable and standardized connections; easy integration of doors, windows, screens, etc., into panels and structure; significant time savings during assembly and disassembly, due to retractable and removable fasteners and limited use of tools; requires less manpower per structure assembly compared with conventional or permanent type structures; and no measuring, cutting, power, or heavy tools required for assembly.

Additional advantages and benefits include, by way of non-limiting example: lower weight materials with high durability and sustainability; corrosion resistant and water resistant materials; ability to be redeployed, adapted, and reconfigured for dynamic changing in-field requirements; optimized hybrid cost solution between a tent and a traditional rigid structure; and greater versability for use due to modular lightweight, reconfigurable, standardized, componentry suitable for multiple and changing environments.

The above features and advantages, and other features and advantages, of the present teachings are readily apparent from the following detailed description of some of the best modes and other embodiments for carrying out the present teachings, as defined in the appended claims, when taken in connection with the accompanying drawings.

DETAILED DESCRIPTION

A modular utilitarian shelter 100, which may also be referred to as modular shelter 100 or shelter 100, produced with a Rapid Wall Building System (RWBS) including a wall assembly 200 and roof assembly 300 is provided herein. Additionally, a method 500 for assembly the modular utilitarian shelter 100 is provided herein, as described in specification and included schematic representations, and as illustrated by the attached figures. The RWBS components may be used to form a lightweight modular shelter 100.

Figure 1:
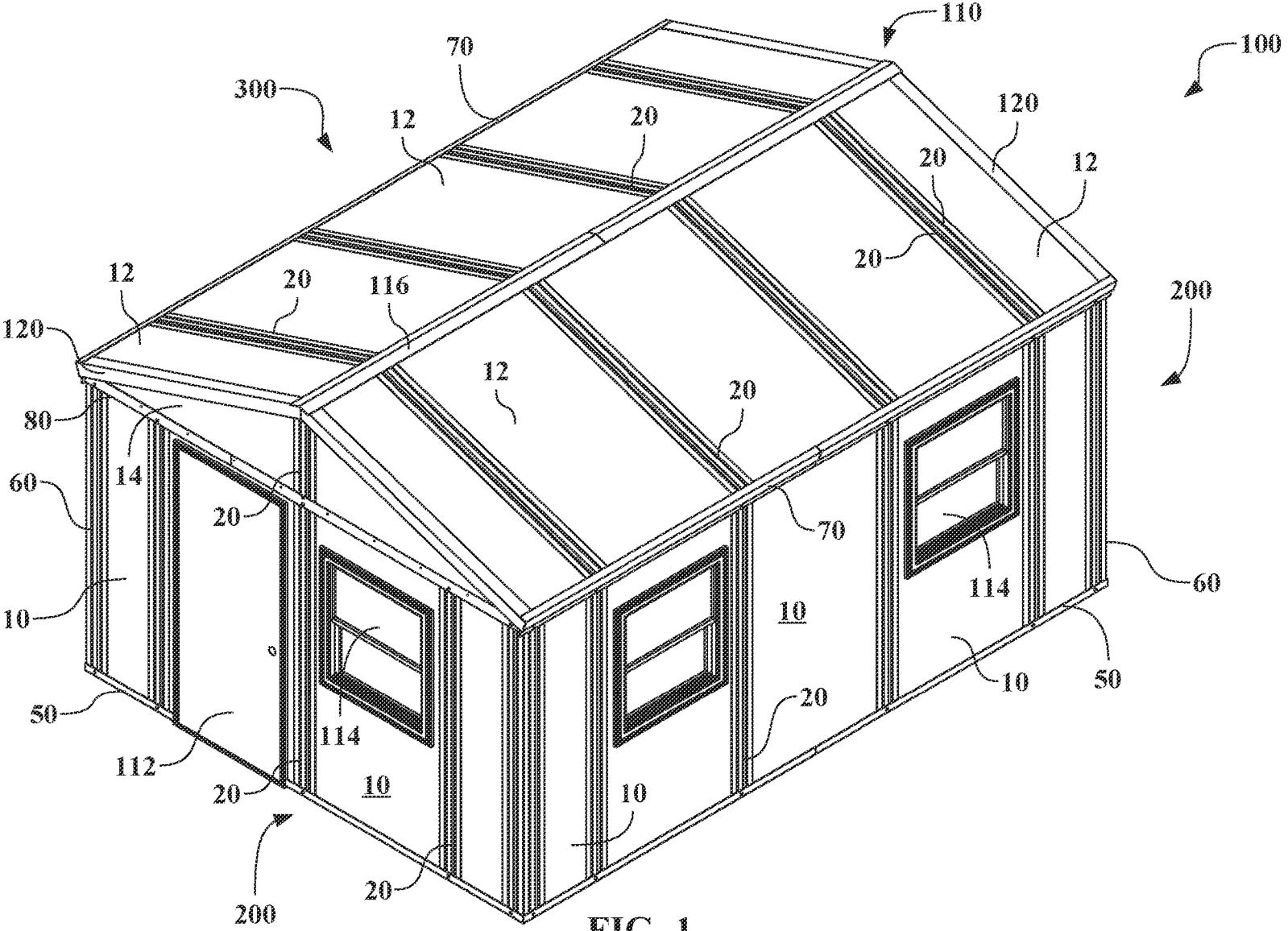
FIG. 1 schematically shows an isometric view of an example shelter constructed using a Rapid Wall Building System (RWBS) with some, or all, of the components and methods described herein.
Figure 2:
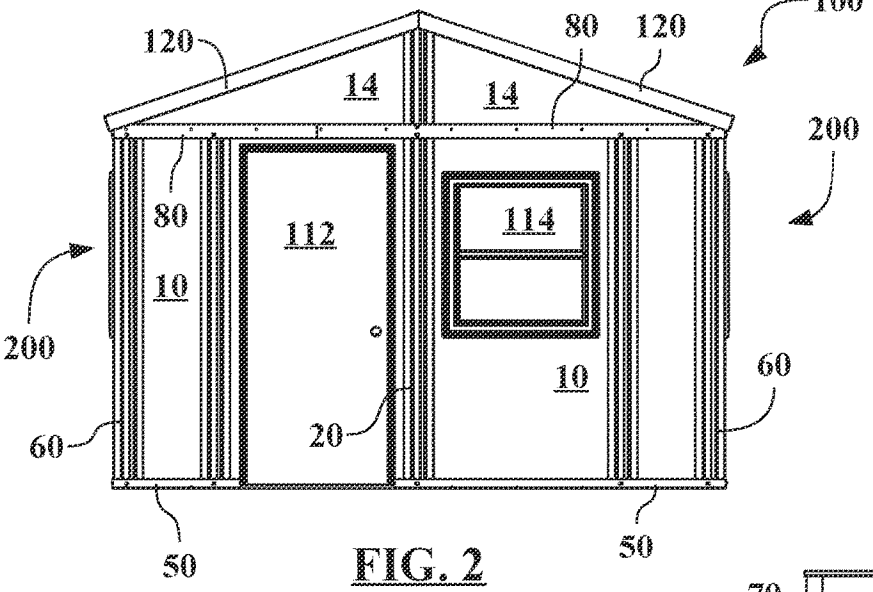
FIG. 2 schematically shows a front elevation view of the shelter of FIG. 1.
Figure 3:
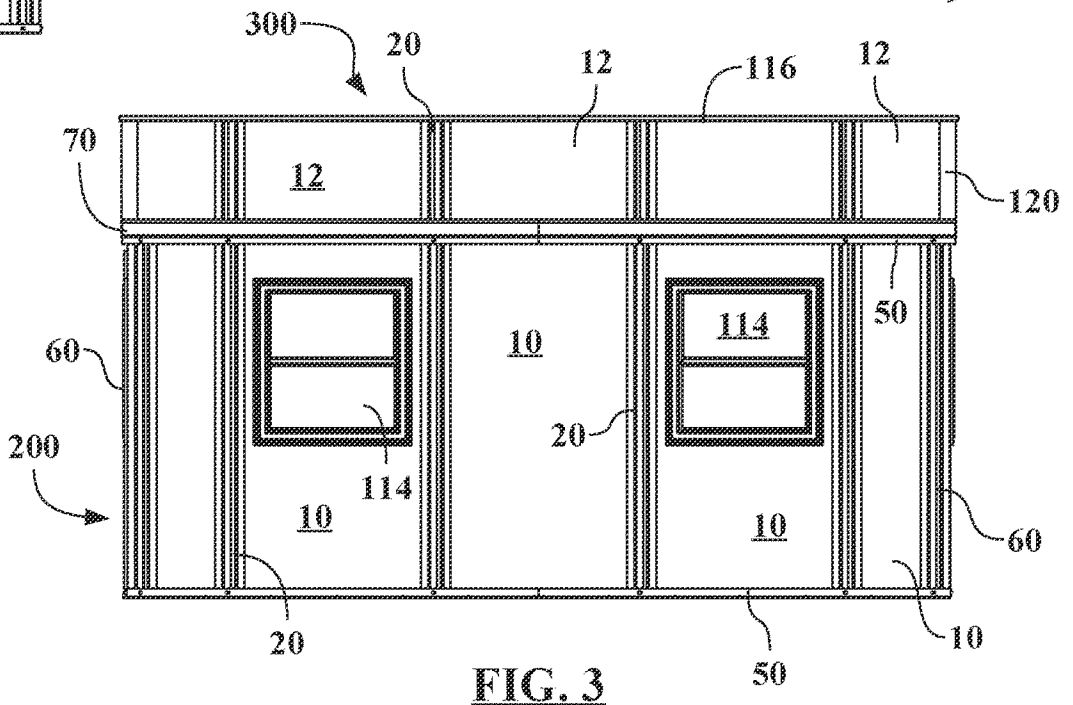
FIG. 3 schematically shows a side elevation view of the shelter of FIG. 1.
Figure 4:
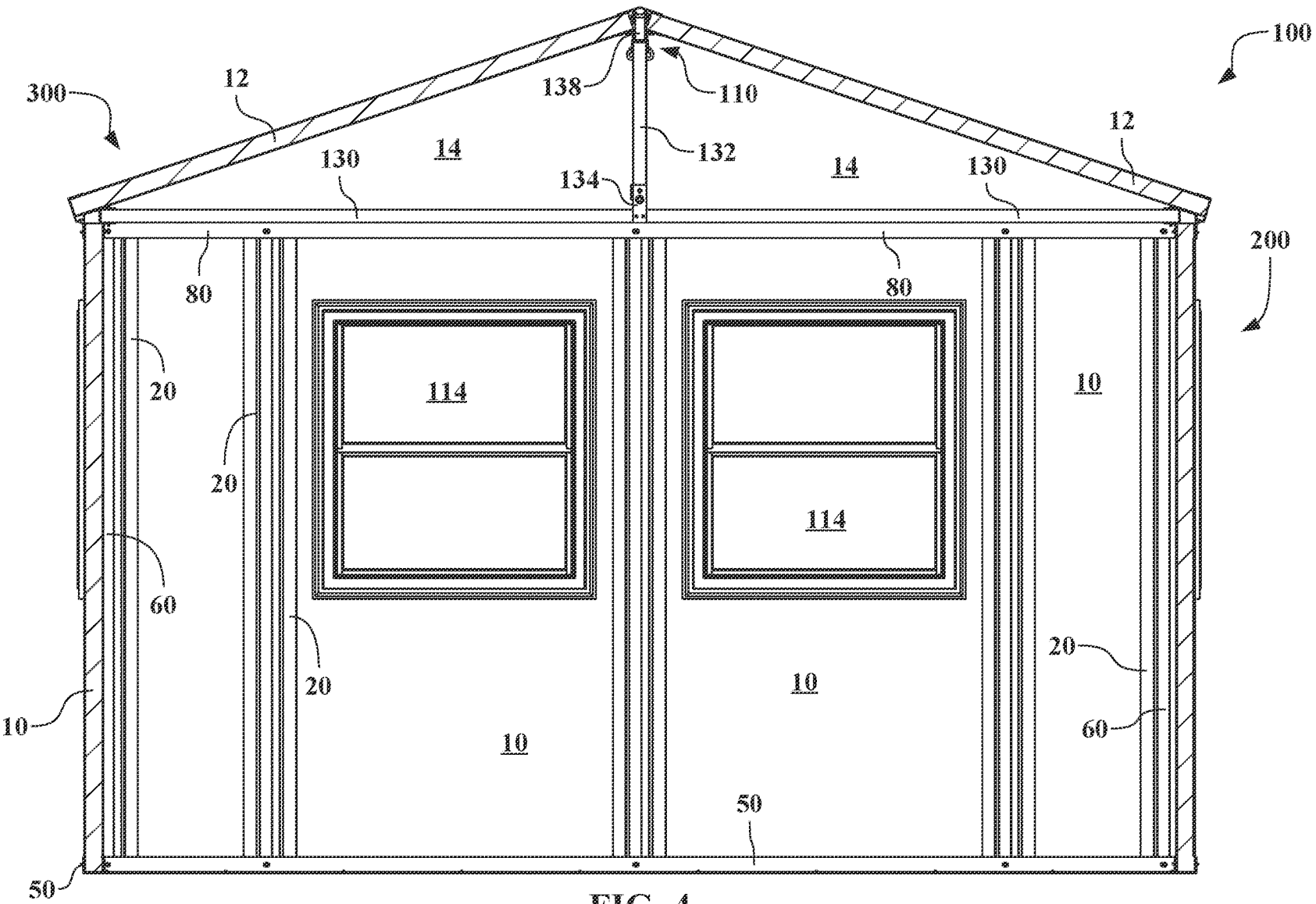
FIG. 4 schematically shows an enlarged cross-sectional view of the shelter of FIG. 1, showing an interior view of gable and wall assemblies, and a back wall having two windows.

FIGS. 1-3 show isometric, front elevation, and side elevation views, respectively, of one exemplary structure of the modular shelter 100 constructed using the components and methods of the RWBS described herein. FIG. 4 shows a cross-sectional view taken at a side midpoint, which shows interior components and a rear wall of the shelter 100. Note that the example modular shelter 100 shown in the figures is a very small, and basic, representation of the capabilities of the RWBS system.

In the drawings, like reference numbers represent like or similar components throughout the several figures, wherever possible, and the elements shown in the figures are not necessarily to scale or proportion. Accordingly, the particular dimensions and applications provided in the drawings presented herein are not to be considered limiting. Reference numbers may not be presented in order.

When used, the term "substantially" refers to relationships that are ideally perfect or complete, but where manufacturing realties prevent absolute perfection. Therefore, substantially denotes typical variance from perfection. For example, if height A is substantially equal to height B, it may be preferred that the two heights are 100.0% equivalent, but manufacturing realities likely result in the distances varying from such perfection. Skilled artisans will recognize the amount of acceptable variance. For example, and without limitation, coverages, areas, or distances may generally be within 10% of perfection for substantial equivalence. Similarly, relative alignments, such as parallel or perpendicular, may generally be considered to be within 5%.

As used in this specification, the term "or" includes any one, and all, combinations of the associated listed items. The term "any of" is understood to include any possible combination of referenced items, including "any one of" the referenced items.

The RWBS and modular shelter 100 constructed therefrom is advantaged by comprising a minimal number of standardized components which are attachable to each other with either manual force only, or use of a mallet, hammer, or similar pounding tool capable of providing a pounding or hammering force. As such, the modular shelter 100 can be assembled at any location by persons having minimal and/or no construction experience or skill, with minimal and/or no training and without the need for electrical power or tools other than the pounding tool. Notably, because the modular shelter 100 can be assembled without the use of power tools, the modular shelter 100 can be assembled in locations where electrical power, generators, batteries, etc., are not available.

The various shelter components are lightweight for portability and are connected to each other by detachable means, including, without limitation, a plurality of retractable connectors 64 or ergonomically advantaged T-bolt fasteners, to facilitate both quick assembly and disassembly. Therefore, the modular shelter 100 is capable of reuse of the components in different combinations and configurations, and rapid disassembly and relocation. The modular shelter 100 may be moved or altered, for example, in response to changes in the installed environment, including climatic changes or changes in response to military and/or government actions, food and water accessibility, or other humanitarian needs or conditions.

Figure 5A:
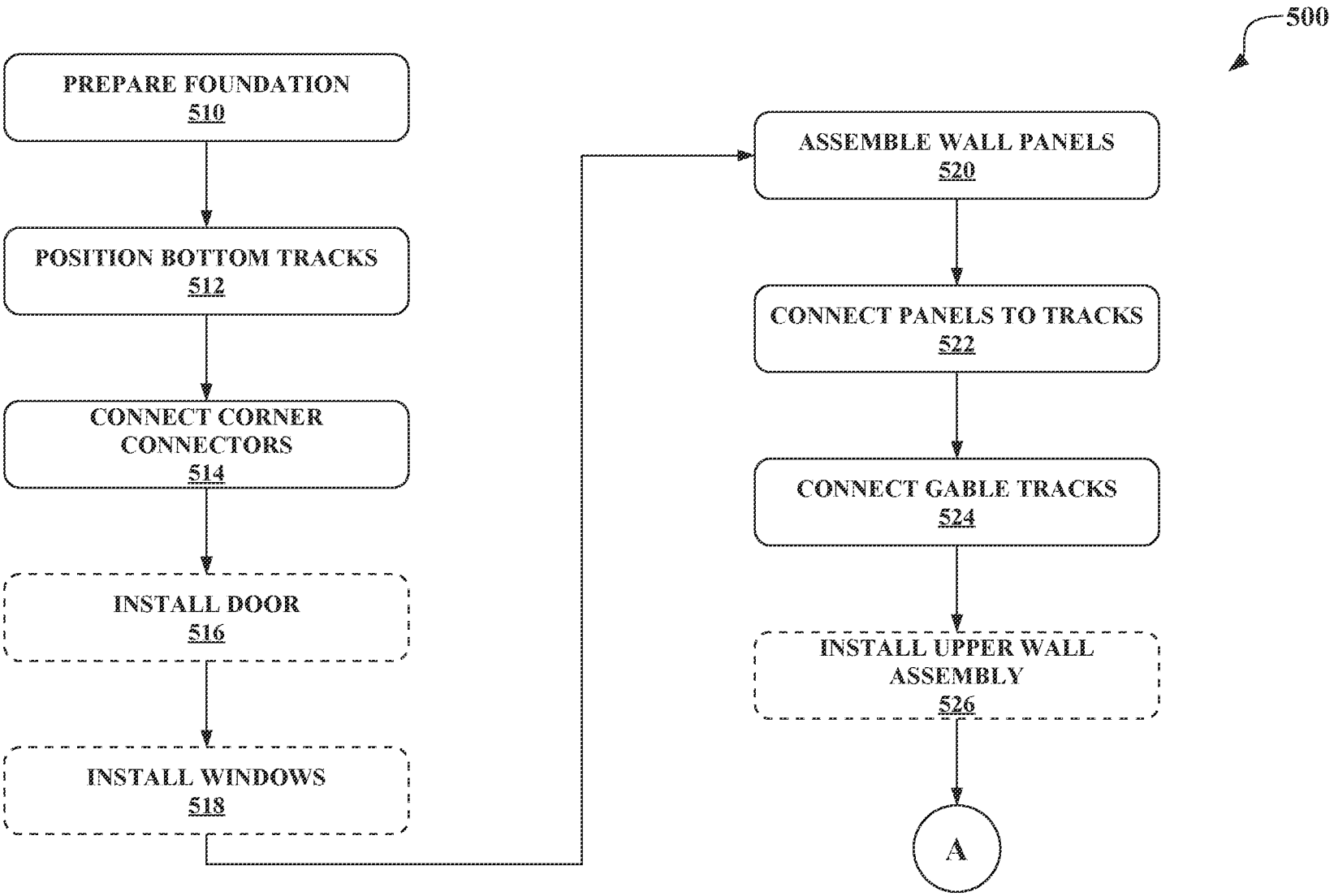
FIG. 5A, FIG. 5B, and FIG. 5C schematically, and collectively, illustrate an example method of constructing or assembling a modular shelter using the RWBS.
Figure 5B:
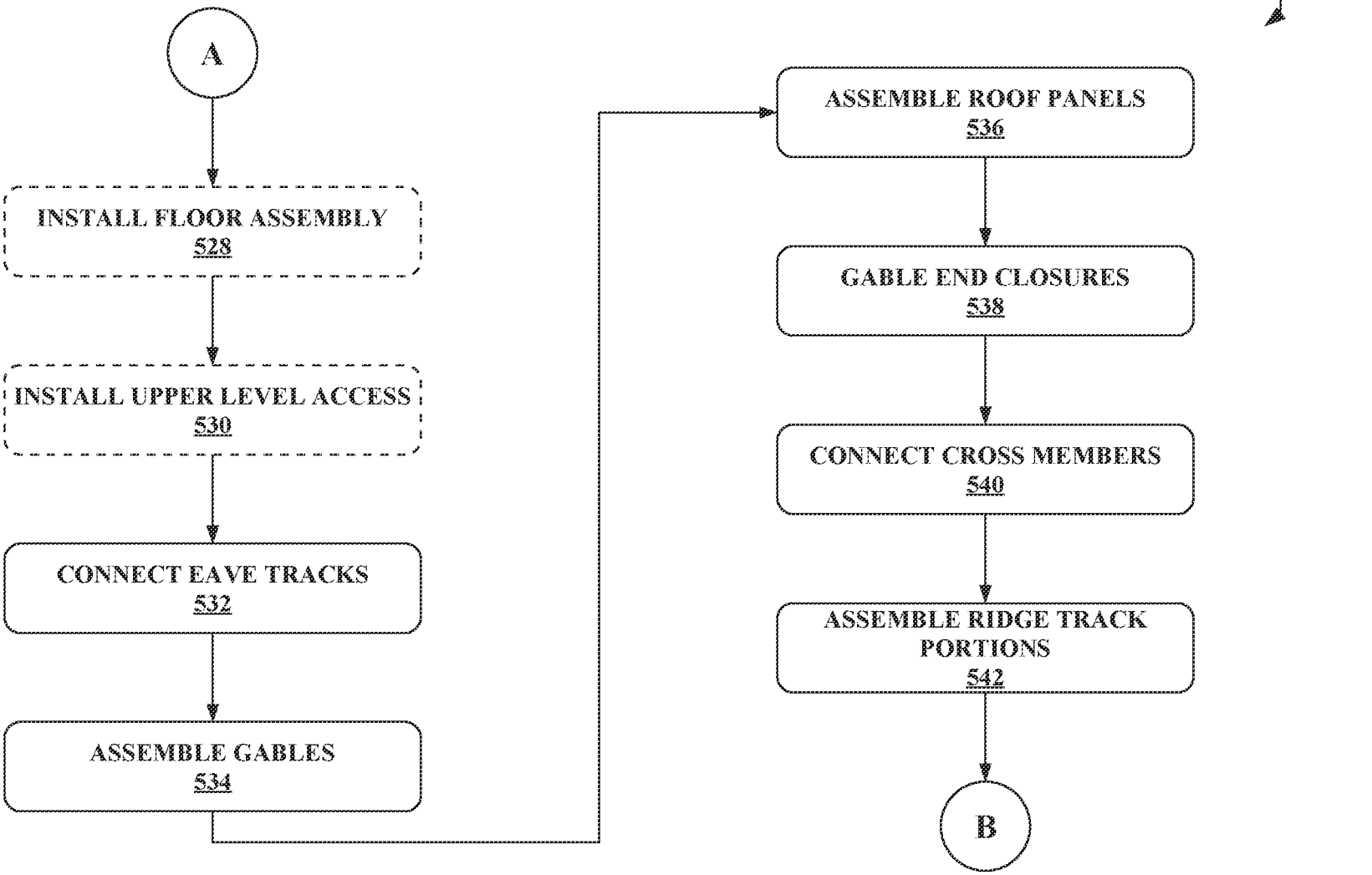
Figure 5C:
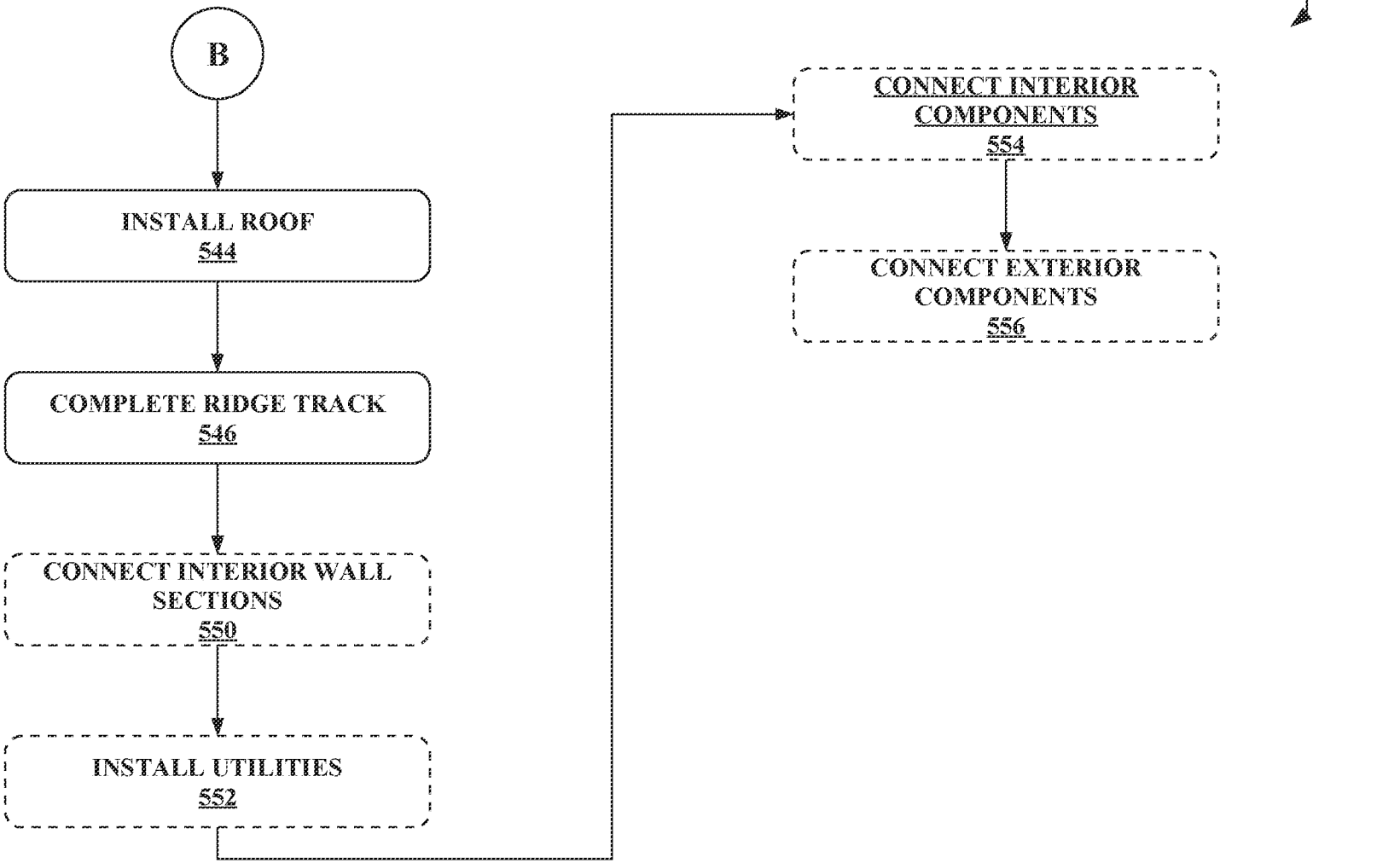

The non-limiting example method 500 of assembling—such as by constructing or erecting—the modular shelter 100 is illustrated by FIGS. 5A-5C of the attached drawings. The illustrative examples provided by the description herein and the related figures are non-limiting, and it would be understood that a plurality of alternative configurations of the shelters 100 exist within the scope of the description to assemble a plurality of differently shaped wall assemblies incorporating various combinations components described, and other similar components.

The RWBS modular shelter 100 is formed from a number of standardized components, including, without limitation: a plurality of wall panels 10, a plurality of roof panels 12, and a plurality of gable panels 14. Furthermore, a plurality of panel connectors 20 and a plurality of corner connectors 60 may be used to tie or connect each of the different panels together.

Note that the wall panels 10 and the roof panels 12, in particular, may be very similar, such that each is usable for the other purpose and/or may be cut into gable panels 14. Furthermore, the panel connectors 20 may be used as panel connectors 20, roof panel connectors 20, or gable panel connectors 20.

A plurality of tracks, including a wall panel bottom track 50 (or simply bottom track 50), an eave track 70, and a gable track 80 may be used to assemble a plurality of differently shaped shelters 100, as required by a specified application and/or anticipated use. Other configurations of roof assemblies 300 may be used with the wall assembly 200, including, for example, conventional and/or known roofing structures, tarps, including roof coverings configured from materials, including natural materials accessible at and/or harvested from the installation location. It is further understood that the shelter 100 and/or the components comprising the shelter 100 can be adapted for installation of electrical, plumbing, lighting, heating, ventilation, air conditioning, solar power, and communications systems, as required by the specified application and/or anticipated use.

The shelter 100 as described herein is advantaged by its flexibility as a temporary shelter, e.g., by the ability to assemble the shelter 100 in a minimal amount of time, including less than one day. Furthermore, as needed, the shelter 100 may be disassembled in a minimal amount of time, including less than one day, for relocation and reassembly, and/or for reassembly into a differently configured shelter 100. Relocation and reassembly may occur via reconfiguration of the component parts and/or by combination or trading of the disassembled component parts with additional component parts.

The example of a temporary shelter is non-limiting, as the durability of the shelter 100, and its individual components, allows for installation of the shelter 100 as a semi-permanent and/or permanent structure, which can include installing the shelter 100 to a foundation provided to make the shelter 100 more permanent. Additionally, the shelter 100 may be raised off of the ground, such as in areas that are flood prone. Although not illustrated, the modular shelter 100 may include floor panels that are attached to the bottom tracks 50 or that are laid on the ground. Examples of structures that can be replaced by various configurations of the shelter 100 may include, without limitation: L-shaped, T-shape, U-shaped, and multi-level structures. Note that the corner connectors 60 may be turned around relative to their position FIGS. 1-3, such that they act as interior corners.

The Rapid Wall Building System (RWBS) described herein includes standardized components that may be assembled in various configurations to construct the modular shelter 100. As shown in the drawings and described in further detail herein, the RWBS standardized components, which may be combined in various quantities of the various components to construct various shelters 100, including at least one wall panel 10 and at least one panel connector 20.

Figure 10:
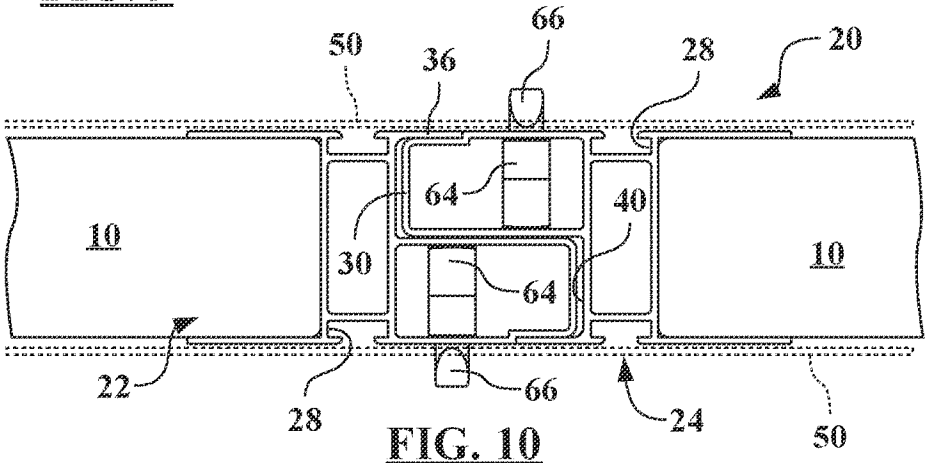
FIG. 10 schematically shows an end view of two panel assemblies connected via panel connectors and retractable button connectors.

The retractable connectors 64 may be used to connect the other elements or components together. The retractable connectors 64 include retractable buttons 66 that are spring loaded such that they are selectively extendable from the retractable connectors 64. For example, the retractable connectors 64 may be used to connect the bottom tracks 50 to the panel connectors 20 or to the corner connectors 60. FIG. 10 schematically illustrates use of the retractable connectors 64 to tie two panels connectors 20 to the bottom track 50, which is schematically illustrated in dashed lines. Similarly, the retractable connectors 64 may be used to connect the panel connectors 20 to the eave tracks 70 or the gable tracks 80. Note that alternative spring-based connector elements may be used, including, without limitation, hairpin shaped spring connectors with buttons that interface with the apertures formed in the components being connected. The hairpin spring connectors may also be used during transportation and subsequently replaced by the retractable connectors 64 or reused within the shelter 100.

All, or some, of the components referred to herein may be collectively referred to as RWBS components, and each of which may be referred to herein as an RWBS component. As shown in the example figures, the different panel members can be provided in different shapes, heights, lengths, and widths to form the plurality of wall panel 10 members, roof panel members 12, and gable panel 14 members, that are used to construct various configurations of the modular shelter 100.

FIGS. 5A-5C show the exemplary method 500 for constructing a shelter using the RWBS components shown in additional detail in the remaining figures. The discussion of FIGS. 5A-5C also introduces additional components, which are illustrated in additional figures, including FIGS. 1-4 and FIGS. 6-20.

The description may move between the method 500 and the individual components and figures demonstrating the components. Note that additional, or fewer, steps may be included with the method 500 shown in the figures. The RWBS shelter 100 created with the method 500 and the RWBS components described and illustrated herein may have a life span of greater than twenty years.

Step 510: Prepare Foundation. In the example method 500 for constructing the modular shelter 100 using the RWBS components illustrated in FIGS. 5A-5C, the method 500 begins at step 510 where a foundation for the shelter 100 is prepared. The foundation may be, for example, and without limitation, composed of one or more of concrete, brick, block, wood, polymer-based structural members, decking, posts, pillars, compacted dirt, gravel, stacked rock, or similar foundation materials and configurations, as would be recognized by skilled artisans.

In a non-limiting example, the shelter 100 may be attached to the foundation, for example, by attachment of the bottom tracks 50 to the foundation by fasteners, adhesives, cement and/or by other attachment members configured for that purpose. The examples of foundations given herein are non-limiting, and it would be understood, for example, that the shelter 100 can be constructed on any surface suitable for supporting the wall panel bottom tracks in the configuration required, for example, a square or rectangular arrangement, to receive the wall assemblies 200 and corner connectors 60, and to support the shelter 100 built thereon. In a non-limiting example, the shelter 100 can be constructed without a foundation, by placing the bottom tracks 50 directly on the ground, on a gravel, asphalt, or concrete paved surface such as a road or runway, or on another structure, such as the roof of a building, the deck of a ship, etc. Skilled artisans will recognize numerous options for foundations upon which modular shelters 100 may be placed.

Step 512: Position Bottom Tracks. At step 512, the wall panel bottom tracks 50 are positioned in the configuration of the shelter 100 to be constructed, which in the example shown in FIGS. 1-4 is a rectangular shape. Laying out or positioning the bottom tracks 50 generally defines the outline or footprint of the modular shelter 100 to be constructed. The rectangular example is non-limiting, and it would be understood that other shapes of the shelter 100 can be constructed using various combinations of the RWBS components including numerous additional shapes and sizes, as would be recognized by those having ordinary skill in the art. The shelter 100 may be a single story, e.g., consisting of a first wall assembly 200, or may be multiple stories, consisting of two or more wall assemblies 200 stack upon one another.

Figure 6A:
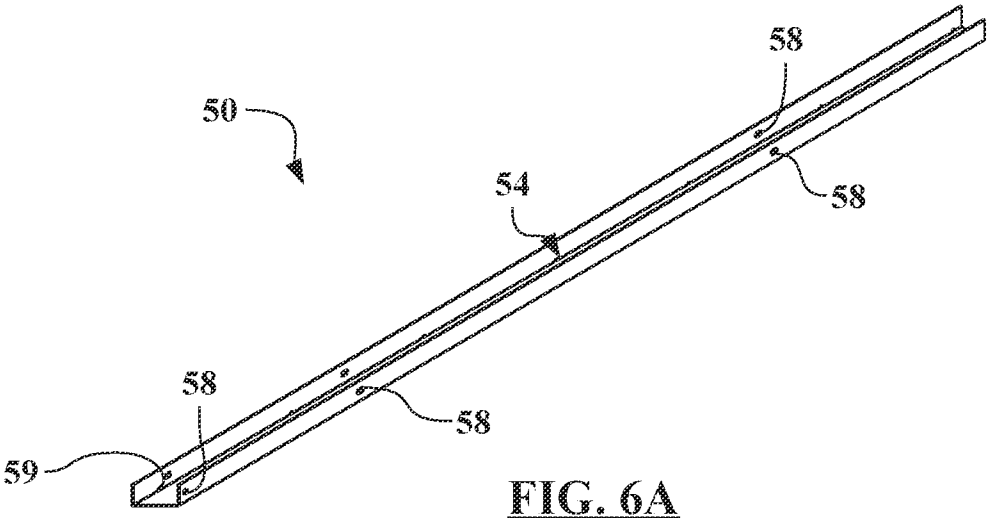
FIG. 6A schematically shows an isometric view of a wall panel bottom track including receiver apertures for connecting wall panel connectors to the bottom track using retractable button connectors.

Referring to FIG. 6A, the wall panel bottom tracks 50 in an example configuration may be formed of a metal-based material, including, without limitation, aluminum or steel, to provide a lightweight and comparatively low-cost component. In one example, the bottom tracks 50 may be formed as an extrusion which is cut to the required length and/or angle. Extrusion is non-limiting, and other methods for forming, including for example, and without limitation, bending and stamping, may be used to form the metal-based bottom tracks 50. The metal-based bottom tracks 50 can be surface treated for corrosion protection, for example, by anodizing, e-coating, painting, galvanizing, plating, or other suitable means for inhibiting and/or preventing corrosion or environmental attack on the bottom tracks 50. One preferred material may be glass filled nylon, which has high strength and stiffness, and excellent melt strength, such that it is well suited for extrusion and blow molding. This material may be molded but is also beneficial when extruded. The glass filled nylon bottom tracks 50 may be lighter in weight than metal-based materials and may also have reduced costs.

Furthermore, and without limitation, the bottom tracks 50 may be formed of a polymer-based material, polymer composite, or carbon fiber reinforced material, such as a nylon-based material, PVC-based material, or high strength polymer, for example, by extrusion or molding. As shown in FIG. 6A, the bottom track 50 defines a track channel 54 for receiving a wall assembly, which may be formed from one or more wall panels 10, one or more panel connectors 20, and/or one or more corner connectors 60.

The bottom track 50 includes a plurality of receiver apertures or apertures 58 positioned to align with the retractable buttons 66 of the retractable connectors 64 of the panel connectors 20. Therefore, when a panel assembly is inserted into the bottom track 50, the retractable connector 64 engages the receiver aperture 58 to retain the wall panel assembly to the bottom track 50. The bottom track 50 may include a step—which is a lowered portion of the bottom track 50, and is best shown in FIG. 2—configured to provide a threshold, for example, for a door 112 installed in the wall assembly 200, as shown in FIGS. 1 and 2, to reduce the stepover height through the doorway.

In one example, the bottom track 50 can include one or more weep holes 59 formed through one or more walls of the bottom track 50 and distributed along the length of the bottom track 50, which can also be referred to herein as drain holes, to provide for drainage of fluid out of the track channel 54 of bottom track 50, including, for example, drainage of rain water or other run-off from the roof assembly 300 or wall panels 10 which may collect in the track channel 54. The bottom track 50 may include, particularly within the track channel 54, one or more seals, such as bulb seals, along the length of the bottom track 50. The seals may limit incursion of water or other liquids into the bottom track 50, such that less water is drained through the weep holes 59.

Figure 6C:
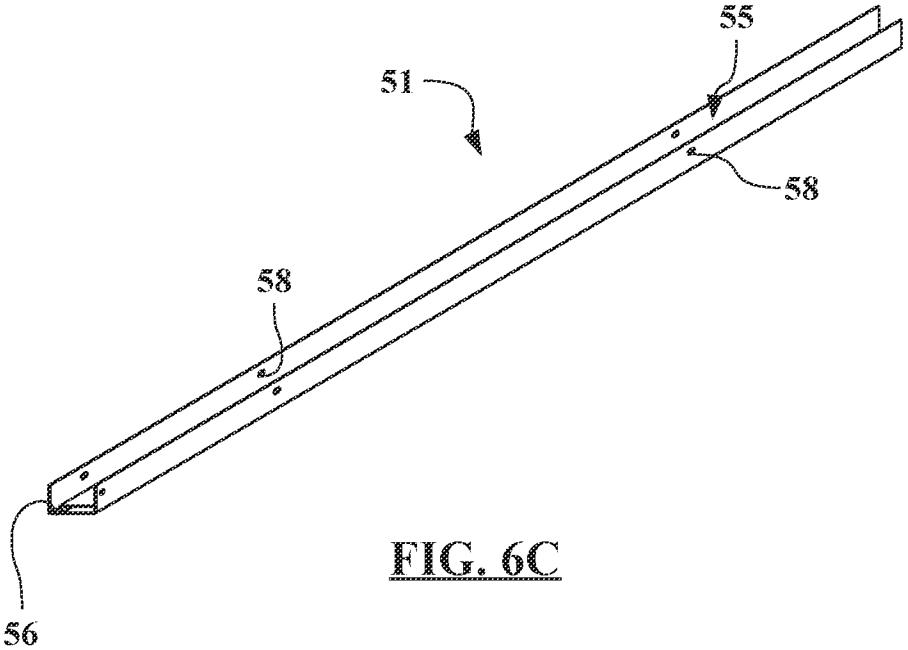
FIG. 6C schematically shows an isometric view of the alternative bottom track.
Figure 6B:
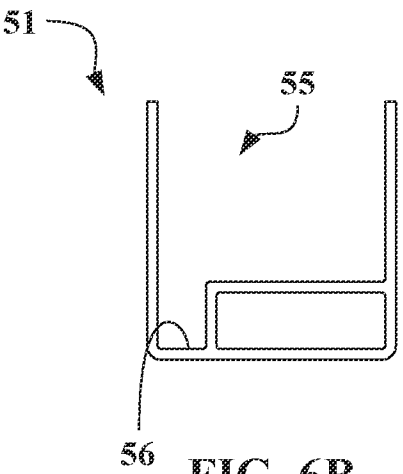
FIG. 6B schematically shows an end view of an alternative bottom track having a gutter.
Figure 8:
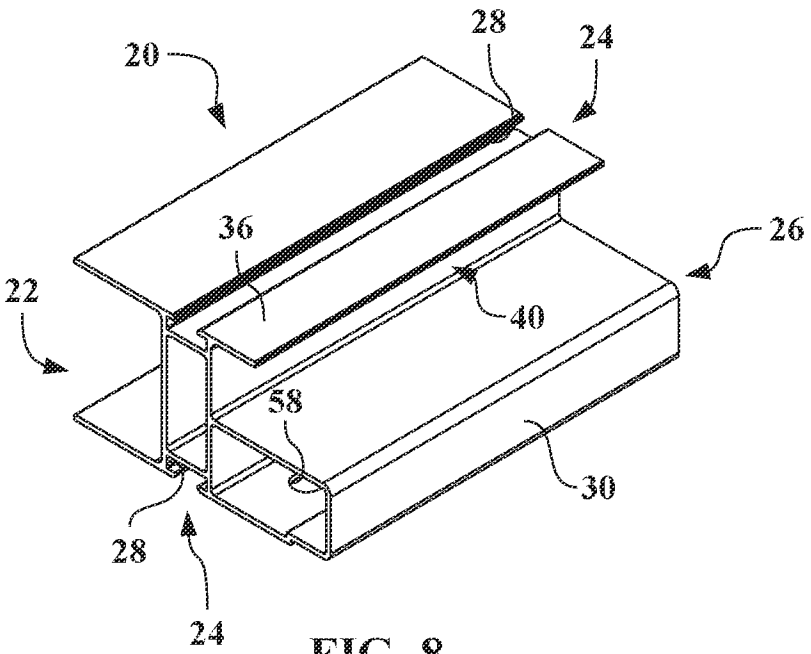
FIG. 8 schematically shows an isometric view of a short section of the panel connector shown in FIG. 7.

FIG. 6B schematically shows an end view of an alternative bottom track 51 and FIG. 6C schematically shows an isometric view of the alternative bottom track 51. The alternative bottom track 51 is similar to the bottom track 50, and includes a track channel 55, but also has some additional features. The alternative bottom track 51 has an offset or raised portion that creates a gutter 56 next to the offset portion. The weep holes 59 may be formed in the gutter 56 to allow water to drain therefrom.

Figure 11:
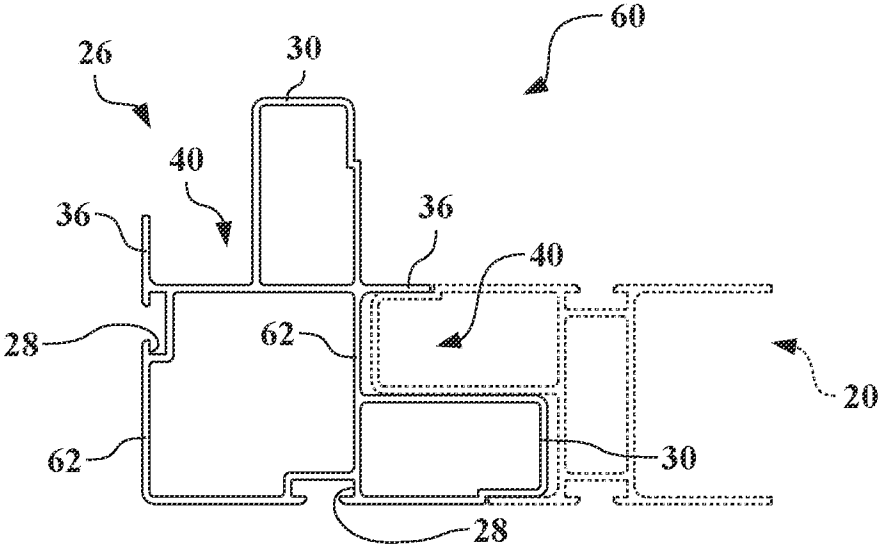
FIG. 11 schematically shows an end view of a corner connector for connecting panel members at corners of the shelter structure.

Step 514: Connect Corner Connectors. At step 514 of the method 500, the corner connector 60 is inserted into and connected to the bottom tracks 50 at one or more of the respective corners of the shelter 100. Similar to the panel connectors 20, the corner connectors 60) include retractable connectors 64 located in connector portions 26 extending orthogonally from a corner channel 62 of the corner connector 60, as illustrated in FIG. 11. Therefore, the corner connectors 60 connect the ends of adjacent, substantially perpendicular, bottom tracks 50 by engaging the retractable buttons 66 of the retractable connectors 64 into the receiver apertures 58 of the bottom tracks 50, to form corners of the shelter 100. FIG. 11 further illustrates the corner connector 60 with an adjacent panel connector 20, shown in dashed lines, to demonstrate connections therebetween.

Figure 12:
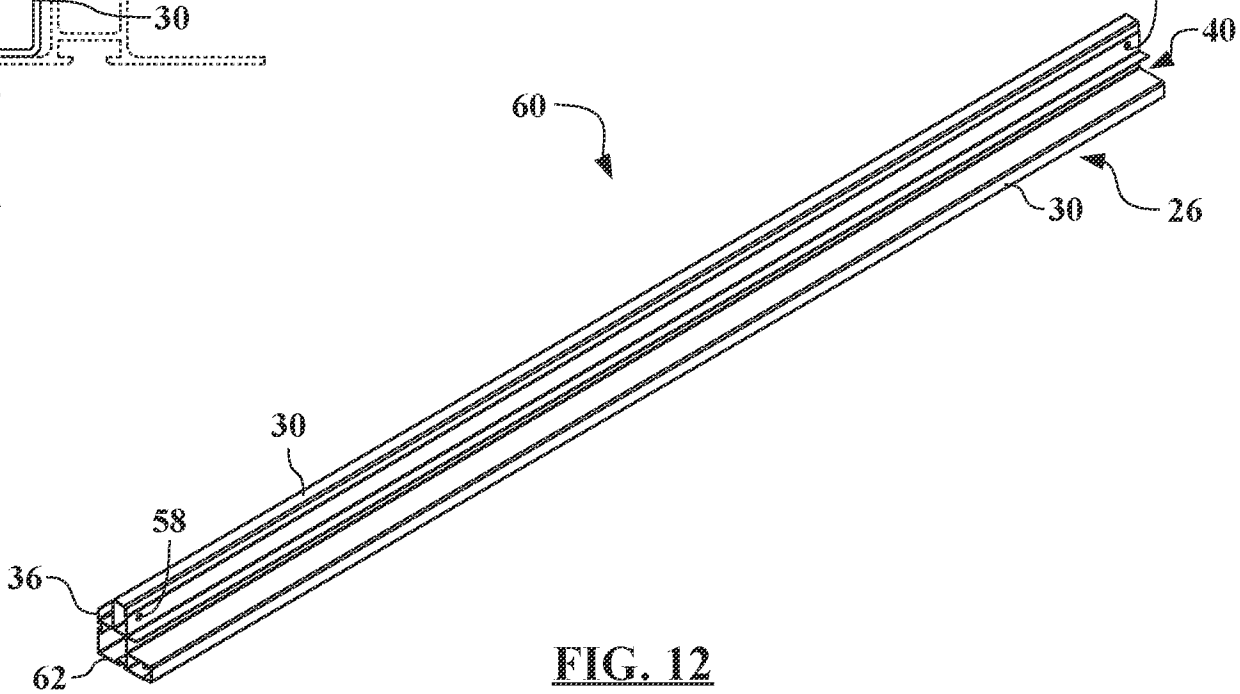
FIG. 12 schematically shows an isometric view of the corner connector for connecting panel members at corners of the shelter structure.

As illustrated in FIGS. 11 and 12, in a non-limiting example, the corner connector 60 can be formed of a metal-based material such as aluminum or steel, to provide a lightweight and comparatively low-cost component. In one example, the corner connector 60 may be formed as an extrusion, which is then cut to the required length. The example is non-limiting, and other methods for forming, including, for example, bending and stamping, can be used to form the corner connector 60. A metal-based corner connector 60 can be surface treated for corrosion protection, for example, by anodizing, e-coating, painting, galvanizing, plating, or other suitable means for inhibiting and/or prevention corrosion of environment attack on the corner connector 60.

Alternatively, and without limitation, the corner connector 60 can be formed of a polymer-based material, polymer composite, or carbon fiber reinforced material, such as a nylon-based material, PVC-based material, or high strength polymer, for example, by extrusion or molding. One preferred material may be glass filled nylon, which has high strength and stiffness, and excellent melt strength, such that it is well suited for extrusion and blow molding. This material may be molded but is also beneficial when extruded. The glass filled nylon corner connectors 60 may be lighter in weight than metal-based materials and may also have reduced costs.

As shown in FIGS. 11 and 12, the corner connector 60 includes the pair of connector portions 26 extending from the corner channel 62 such that when the bottom tracks 50 are connected to the connector portions 26, a corner of the shelter 100 is formed. In the example shown, the connector portions 26 are substantially orthogonal to each other to define a 90-degree corner angle between the bottom tracks 50 and wall panels 10 connected to the corner connector 60. The example is non-limiting, and it will be understood by skill artisans that the corner connector 60 may have connector portions 26 which are non-orthogonal, for example, to assemble the modular shelter 100 with a non-rectangular shape.

For example, and without limitation, the corner connector 60 may have connector portions 26 extending from the corner channel 62 to define a 108-degree angle therebetween, which could be used to assemble a pentagonal shaped wall assemblies 200; or the corner connector may have connector portions 26 defining a 120-degree angle therebetween could be used to assemble a hexagon shaped wall assemblies 200, and the like. Further, combinations of corner connectors 60 having different included angles could be used to connect bottom tracks 50 to assemble a wall assembly 200 having an irregular polygon shaped perimeter.

Advantageously, the RWBS including standard components including the panel connectors 20 and the corner connectors 60, as described herein, are configured to assemble wall assemblies 200 having various perimeter shapes and perimeter sizes, and can be disassembled and recombined to form wall assemblies 200 of other perimeter shapes and perimeter sizes. Such that the wall assemblies 200 provide flexibility and reusability of the RWBS components as needs change, relocation or reconfiguration is desired, or combinations thereof, for the shelters 100.

Referring again to the corner connector 60 shown in FIGS. 11 and 12, the connector portions 26 are connected to the corner channel 62 by a bridge portion 24 which includes a connector slot 28 defined by in an exterior surface of the corner connector 60. Similarly, the panel connector 20 shown in FIGS. 7-10 also includes a similar connector portion 26, which is connected to a panel edge channel 22 by a bridge portion 24 which includes opposing connector slots 28 defined by opposing surfaces of the panel connector 20. In the example shown, the connector slot 28 is a generally T-shaped slot such that the connector slot 28 is configured to receive a fastener—for example, and without limitation, a T-bolt—for attachment of objects to the corner connector 60 via the connector slot 28.

As shown in the figures, each of the panel connectors 20 shown in FIGS. 7-10 and the corner connectors 60 shown in FIGS. 11 and 12 includes at least one connector slot 28. Note that the panel connectors 20 may be used to connect both the wall panels 10 and the roof panels 12.

In the installed position, the connector slot 28 can be located on an outwardly facing surface (exterior to the shelter 100 as installed) of the panel connector 20 or the corner connector 60 for attachment of various exterior components to the shelter 100. The types and configurations of exterior components that may be connected to the exterior of the wall assembly 200, gable, the roof assembly 300, or combinations thereof, of the shelter 100 using the connector slots 28 is unlimited. The exterior components, include, without limitation: brackets, hangers, shelving, storage containers, awnings, electrical and/or plumbing conduit, lighting fixtures, communication equipment, other utility components, water collection reservoirs, solar panels, perimeter fencing, wall extensions, and other exterior components recognizable to skilled artisans.

In the installed position, the connector slot 28 can be located on an inwardly facing surface (interior to the shelter 100 as installed) of the panel connectors 20 or the corner connectors 60, for attachment of interior components to the shelter 100. The types and configurations of interior components that may be connected to the interior of the wall assembly 200, gable, and/or the roof assembly 300 of the shelter 100 using the connector slots 28 included in the connectors is unlimited. The interior components, include, without limitation: brackets, hangers, shelving, storage containers, electrical and/or plumbing conduit, equipment, lighting fixtures, communication equipment, other utility components, work tables or desks, plumbing fixtures, beds, cots, bunks, storage shelving, containers, interior walls and/or wall extensions, and other interior components recognizable to skilled artisans.

As shown in the figures, the connector slots 28 extend the full length of the corner connector 60 and the full length of the panel connector 20, such that attachment can be made to the connector slot 28 at any position along the length of the panel connectors 20 or corner connectors 60. This allows for flexibility of use, easy repositioning of components, or both. The connectors slots 28 can be formed during extrusion and/or molding of the panel connectors 20 or corner connectors 60, such that the fabrication cost of the connector slots 28 is minimal.

The example is non-limiting, and other means for forming the connector slots, including machining, stamping, etc., could be used. In the non-limiting example shown, the connector slot 28 has a generally T-shaped cross-section such that a T-bolt end of a fastener can be inserted at any position along the length of the slot and rotated to retain the T-bolt end within the connector slot 28. The example is non-limiting, such that it would be anticipated within the scope of this disclosure that other slot shapes and/or configurations could be formed in the panel connectors 20 or corner connectors 60 to provide attachment means for attachment of interior and exterior components and/or wall extensions to the panel connectors 20) or corner connectors 60.

Referring again to the corner connector 60 shown in FIGS. 11 and 12, and to the panel connector 20 shown in FIGS. 7-10, the connector portions 26 include a connector plug 30 and a connector socket 40, which are configured such that the connector portions 26 of adjacent panel connectors 20 or corner connectors 60 can be connected—i.e., fitted to each other as illustrated in FIG. 10—by insertion of the connector plug 30 of one panel connector 20 or corner connector 60 into the connector socket 40 of an adjacent panel connector 20 or corner connector 60. The interfaces between the connector plug 30 and the connector socket 40 may be sealed to reduce flow of air or liquid therebetween.

Figure 7:
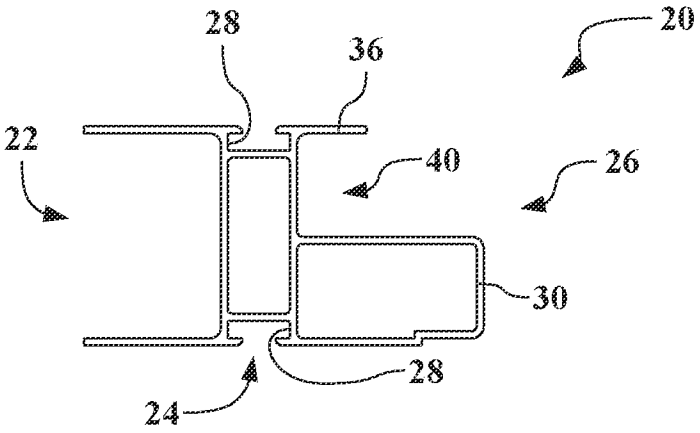
FIG. 7 schematically shows an end view of a panel connector for connecting panel members.

As shown in FIGS. 7 and 11, the connector plug 30 includes a plug end that, in some configurations, may be tapered to facilitate insertion of the connector plug 30 into the connector socket 40. However, the plug end shown in the figures substantially lacks tapering. The plug end is seated into a socket channel defined at least partially by a socket flange 36. In the non-limiting example shown, the plug end is recessed to interface with the socket flange 36, which may promote sealing the joint formed between the abutting panel connector 20 or corner connector 60 against fluid (air, water) flow (ingression, leakage) through the joint at the outer surfaces of the abutting connector portions 26.

As shown in FIG. 10, the non-linear and/or multi-directional joint interface defined by the surfaces of the interconnected plugs 30 and sockets 40 of the abutting connector portions 26 further seal the joint to prevent fluid flow through the joint. In some configurations, the panel connectors 20 or corner connectors 60 can include one or more plug seals positioned in, or along the length, of the socket channel, to additionally seal the joint between the abutting connector portions 26. In one example, the plug seal may be made of an elastomer, polymer, or rubber like material which is compressible such that the plug seal is compressed during insertion of the plug end into the socket channel, to seal the joint.

Non-limiting example configurations of the plug seal include bulb seals, D-shaped seals, O-shaped seals, etc. In one example, the panel connectors 20 or corner connectors 60 are provided with the plug seal pre-applied to the socket channel. In another example, the panel connectors 20 or corner connectors 60 and plug seals are provided as separate components and the plug seal is attached to the socket channel during assembly of the shelter 100. In a non-limiting example, the plug seal can be adhered to the socket channel by an adhesive or other fastening means, and/or the plug seal can include an adhesive strip for adhering the plug seal to the socket channel.

Referring again to the corner connector 60 shown in FIGS. 11 and 12, and to the panel connector 20 shown in FIGS. 7-10, the connector plug 30 of the connector portion 26 includes a connector housing for housing the retractable connectors 64 within each end of the connector portion 26. In the examples shown in the figures, the retractable connectors 64 are configured with the spring-loaded retractable buttons 66, which may also referred to herein as buttons 66, that protrude through apertures 58 formed in the connector housing of both the panel connectors 20 and corner connectors 60.

As shown in the figures, the connector portion 26 has the retractable connector 64, including the retractable button 66, inserted to each end of the panel connectors 20. As such, in an installed position the connector portions 26 of the panel connectors 20, and also the corner connectors 60, are attached at a first end (lower end, as installed) to the bottom tracks 50 by engaging the retractable buttons 66 of the retractable connectors 64 in the receiver apertures 58 of the bottom tracks 50, to form the wall assembly 200 of the shelter 100 shown in FIG. 1 and described in the method shown in FIGS. 5A-5C. Note that the apertures 58 of the corner connectors 60 and the panel connectors 20 may be considered pass through apertures.

Figure 19:
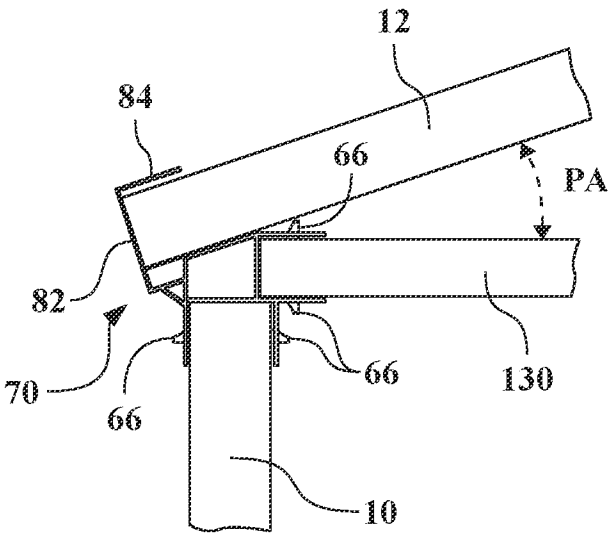
FIG. 19 schematically shows an end view of the eave track connecting a wall panel, a roof panel, and a cross member.
Figure 20A:
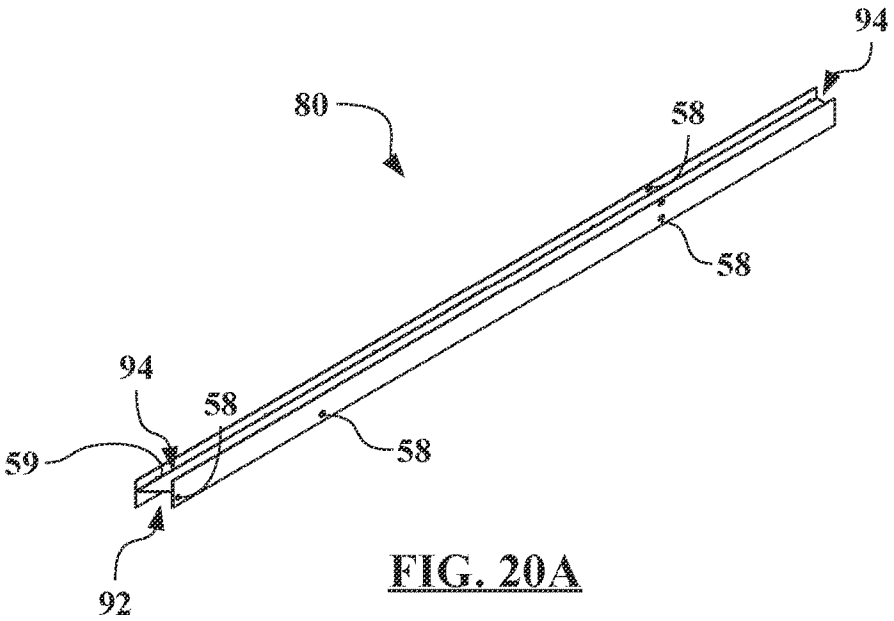
FIG. 20A schematically shows an isometric view of a gable track, which is configured to mate the top of end wall assemblies to gable elements.

As illustrated in FIGS. 4 and 19, the second ends (upper ends, as installed) of the corner connectors 60 and the panel connectors 20 are attached to a second track, which is either the eave track 70 (best viewed in FIGS. 13 and 14) or the gable track 80 (best viewed in FIG. 20A). Engagement generally occurs via the retractable buttons 66 of the retractable connectors 64 at the second ends of the corner connectors 60 and the panel connectors 20 to receiver apertures 58 formed in the eave tracks 70 and gable tracks 80, to form the upper edge of the wall assembly 200, as viewed in FIGS. 1-4.

Referring to FIGS. 7-10, in a non-limiting example the panel connectors 20 can be formed of a metal-based material such as aluminum or steel, to provide a lightweight and comparatively low-cost component. Although this discussion focuses on the panel connectors 20, similar construction methods, materials, and treatments may be used for the corner connectors 60, the eave tracks 70, the gable tracks 80, and a gable end track 120 (best viewed in FIGS. 1 and 2), or other components of the RWBS system, as will be recognized by skilled artisans. In one example, the panel connector 20 may be formed as an extrusion, which is then cut to the required length and/or miter angle, for example, to form the wall panel connectors 20, roof panel connectors 20, or gable panel connectors 20.

The extrusion example is non-limiting, and other methods of forming, including bending and stamping, can be used to form the panel connectors 20. The metal-based panel connectors 20, in addition to the other components, can be surface treated for corrosion protection, for example, by anodizing, e-coating, painting, galvanizing, plating, or other suitable means for inhibiting and/or prevention corrosion of environment attack on the panel connector 20. In a non-limiting example, the panel connector 20 can be formed of a polymer-based material, polymer composite, or carbon fiber reinforced material, such as a nylon-based material, PVC-based material, or high strength polymer, for example, by extrusion or molding.

One preferred material may be glass filled nylon, which has high strength and stiffness, and excellent melt strength, such that it is well suited for extrusion and blow molding. This material may be molded but is also beneficial when extruded. The glass filled nylon panel connectors 20 may be lighter in weight than metal-based materials and may also have reduced costs. In one example, the wall, roof, and gable panel connectors 20 are formed of the same material, which in a preferred example is extruded and/or molded in a continuous length which can then be cut to the lengths required for each of the respective wall, roof and gable panel connectors 20.

Alternatively, the wall panel connectors 20 may be made of a different material than the roof panel connectors 20 or gable panel connectors 20, according to the use requirements of the shelter 100 including these components. For example, the panel connectors 20 may be made of a metal-based material according to the rigidity or column strength requirements of the wall assembly 200, and the roof panel connectors 20 may be made of a lighter non-metallic or polymer-based material where sufficient for supporting the roof loading requirements, to provide a lighter weight roof panel 12 for ease of lifting and placement during assembly of the roof assembly 300. The examples are non-limiting and other combinations made be used.

Figure 9:
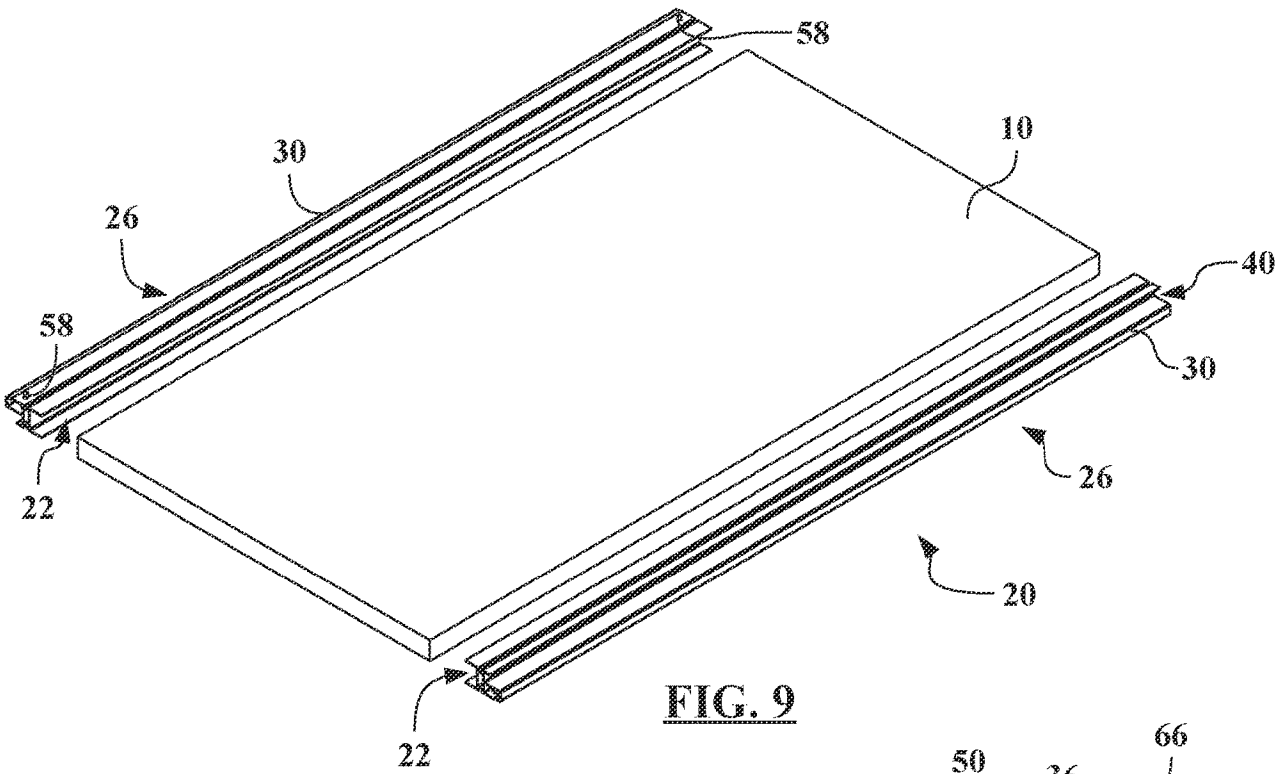
FIG. 9 schematically shows an exploded view of a panel assembly having a panel member and opposing panel connectors.

As shown in FIGS. 7-10, the panel connector 20 includes the connector portion 26, which is connected to the panel edge channel 22 by the bridge portion 24 that includes opposing connector slots 28 defined on opposing sides of the panel connector 20. Advantageously, the connector portion 26, including the connector plug 30 and connector socket 40, is configured such that the panel connector 20 can be installed to either side edge of the wall panel 10, as shown in FIGS. 9 and 10, such that there is no requirement for left and right panel connectors 20. This simplifies inventory management and simplifies assembly by precluding the need to provide different left and right connectors, thus eliminating assembly errors which could occur if differently configured left and right connectors were required. Furthermore, the panel assemblies—generally including one wall panel 10 and two panel connectors 20—can be turned about their lateral and/or longitudinal axis during installation to align the corresponding plugs 30 and sockets 40 of adjacent panels, such that the same configuration panel assembly can be used throughout the wall assembly 200, simplifying inventory management and assembly processes.

Further, the wall panel connectors 20, roof panel connectors 20, and gable panel connectors 20, in the preferred example shown, have the same cross-sectional shape and size, such that all of the panel connectors 20 can be cut to length from a standardized extrusion or molded blank, reducing manufacturing and tooling costs. Standardization of the cross-sectional shape of the extrusion or molded blank can also be beneficial, for example, where in-field repairs are required and/or to simplify spare parts supply and management. For example, the longest of the panel connectors 20 can be provided as a standard repair part, which can be shortened, if needed, to the length required for the panel connector 20 being replaced in the field, minimizing spare parts inventory and complexity. The panel connectors 20 may also be cut at angles, such as when used as gable panels connectors 20.

Optional Step 516: Install Door. At optional step 516, and as illustrated in the non-limiting examples shown in FIGS. 1 and 2, at least one wall panel 10 can be provided as a wall panel member including a door assembly or door 112, which may also be connected to panel connectors 20 to form a wall door panel with door 112. In some configurations, the entire wall panel 10 may be replaced the door 112.

Optional Step 518: Install Window(s). Similarly, at optional step 518, and as illustrated in the non-limiting examples shown in FIGS. 1-4, at least one wall panel 10 can be provided as wall panel member including a window assembly or window 114 and connected to panel connectors 20 to form a wall window panel member. In many configurations, one or more special wall panels 10 will have the window 114 preassembled therein, such that the window wall panel 10 is simply installed like any of the other wall panels 10.

These examples are illustrative and non-limiting, and it would be understood that other configurations of wall panels 10 can be included in the shelter 100. Alternative wall panels 10, include, without limitation, those having a panel frame and a panel insert. The panel frame can be configured to be received into the track channel 54 of the bottom track 50. The panel insert which may be of various configurations as required by the use of the shelter 100. For example, and without limitation, the panel insert may be configured for surveillance and composed of a reinforced, tinted, and/or bullet resistance material. Additional example panel inserts may be made of a screen or mesh material for ventilation of the shelter 100. Additional panels, including the roof panels 12 and gable panels 14, can include panels having a panel frame and/or panel insert.

In an illustrative example, one or more roof panels 12 include a panel insert configured as a window panel or skylight for receiving light into the shelter 100. Other configurations are possible, for example, installing window and/or screen inserts into the gable panels for lighting and/or ventilation. In a non-limiting example, steps 516 and/or 518 are completed prior to transporting the wall panels 10 or roof panels 12 to the location where the shelter 100 is to be constructed. In a non-limiting example, steps 516 and/or 518, and/or the assembly of panel frames and panel inserts can be performed at the location where the shelter 100 is to be assembled. Additionally, the doors 112, windows 114, and/or materials for the panel frames and inserts may be locally sourced, e.g., provided proximate to the assembly location of the shelter 100, and installed to the panels.

Step 520: Assemble Wall Panels. At step 520, the panel connectors 20 may be assembled, attached, or otherwise joined to the wall panels 10. Note that this may be considered an optional step. In many situations, the wall panels 10 will come with the panel connectors 20 pre-attached, such as from the factory or assembly facility, which may simplify construction of the shelter 100 at the installation site.

The wall panels 10, roof panels 12, and gable panels 14, which may collectively be referred to as panel members, are fabricated as lightweight panels for easy transport and handling during assembly of the shelter 100. In a non-limiting example, the panel members, have opposing panel faces defining a panel thickness PT therebetween, opposing panel side edges defining a panel width PW, and upper and lower edges defining a panel height PH. The upper and lower edges of the panel members may be defined relative to the installed position of the respective panel member, but note that in many configurations, the upper and lower edges may be reversible.

In the examples shown in the figures, the wall panels 10 and the roof panels 12 are generally rectangular in shape. The panel members can be formed or fabricated, for example, by trimming or cutting, in other shapes as required to assemble the shelter 100. For example, the gable panels can be formed in triangular shapes. In an illustrative example, the panel members include a core member and having panel faces made of a sheathing material attached to opposing sides of the core member to form a composite or laminate panel member. For example, and without limitation, the panel member is formed of one or more materials selected such that the panel member is lightweight for portability while providing an R-value of at least 2, such that the shelter 100 formed therefrom has better insulative properties than a tent-type structure. In one example, the panel member is characterized by an R-value in the range of about 4 to 10, and in another example, the panel member is characterized by an R-value of 9 or greater, to provide thermal efficiency to the shelter 100 formed therefrom.

For example, and without limitation, the core may formed of a rigid foam material such as a polystyrene-based material. In one example, the rigid foam is a graphene infused polystyrene to provide an insulating core member having an R-value of 9 or greater, and in a preferred example, having an R-value of at least 10 to provide thermal efficiency while maintaining the lightweight characteristics of the panel member. One, or both, of the core member and the sheathing material on the faces are preferably formed of a water resistant, water repelling, and/or hydrophobic materials, to form the modular shelter 100 which is resistant to water ingression. For example, and without limitation, the panel faces are made of a sheathing material attached to opposing sides of the core member, for example, by an adhesive, where the sheathing material forming the panel faces are made of a polymer material such as a fiberglass reinforced polymer (FRP), a polyethylene based polymer, a high density polyethylene elastomer (HDPE), a polyamide, a vinyl based material, or a nylon based polymer material, to provide additional rigidity, strength, and water resistance to the panel member.

In a non-limiting example, the panel member can be formed by laminating the sheathing material to the form core, including applying an adhesive, such as a cold spread glue or spray on adhesive, to one or both of the core member and the sheathing material prior to laminating the layers together to form a panel member. Alternatively, heat may be applied to bond or laminate the sheathing members to the core member, or an expanding foam core may be placed between sheathing members, such that the expanding foam bonds directly to the sheathing members. In a non-limiting example, the foam core construction of the wall panels 10 provides an advantage of being readily modified for installation of doors 112, windows, 114, etc., with minimal hand tools such as a hand saw, knife, or other manual cutting tool, e.g., without the use of specialty or power tools.

One or more of the panel height PH, panel width PW, panel thickness PT and/or the shape of the panel member can be varied to meet the use requirements of the shelter 100 being assembled from the respective panel members. Various configurations and combinations of a core layer and/or one or more panel faces can be used to construct a panel member as needed to meet the use requirements of the shelter 100 formed from the panel member, and/or to provide selective characteristics or properties to the panel member.

For example, and without limitation, the panel member can be configured for intrusion and/or ballistic resistance, fire and/or smoke resistance, water resistance, wind resistance, insulative or other thermal properties, electrical properties, appearance characteristics—including camouflage, light reflecting, light absorbing—or decorative appearance characteristics, etc. The combination of sheathing and core materials may be varied, for example, to provide various configurations of panel members. In one example the panel faces and core member can be formed as a unitary homogeneous structure defining the panel member. In another example, the core member can be formed of multiple layers to provide the desired properties, such as the core member including a ballistic insert, a reinforcement or rigidity insert, for example, for wind resistance and/or load dissipation, etc.

In a non-limiting example, the panel member can include opposing panel faces made of different materials and/or configured to contribute differing properties to the panel member. In a non-limiting, illustrative, example, a panel member can include an exterior (as installed) panel face having weather resistant, camouflage, and/or ballistic properties, and an interior (as installed) panel face having thermally insulative and/or decorative characteristics. All of these examples are illustrative and non-limiting, and it would be understood that panel members comprising other combinations of materials and configured layers would be possible within the scope of the description.

In one non-limiting example, an adhesive can be applied to the channel interior surfaces of the panel edge channel 22, and/or to the panel side edge and/or to the portions of the panel face being inserted into the panel edge channel 22, to adhere the panel member to the channel interior surfaces, thereby attaching the panel connector 20 to the panel member to form the wall panel 10. In one example, the adhesive can be configured as a sealant, and distributed and/or applied to the panel member and/or to the channel interior surfaces to seal the joint between the panel member and panel edge channel 22, to impede and/or prevent fluid flow (water, liquids, air, etc.) through this joint.

Step 522: Connect Panels to Tracks. Referring again to the method shown in FIGS. 5A-5C, at step 522, the wall panels 10 assembled at step 520, or preassembled prior to the installation site, are installed to the respective bottom tracks 50. As referenced herein, the combination of the one of the panel members with one or more of the connector members may be considered a panel assembly.

At step 522, the panel assemblies are connected to each other and to the corner connectors 60, as shown in FIGS. 1-4, and inserted in, and connected, to the wall panel bottom tracks 50. The panel assemblies are connected to the bottom tracks 50 by engagement of the retractable connectors 64 of the panel connectors 20 and corner connectors 60 to the receiver apertures 58 of the bottom tracks 50, to form the wall assembly 200.

As previously described, the panel connectors 20 and corner connectors 60 include the connector portion 26 for connecting to an adjacent panel connector 20 and corner connector 60 as the wall assembly 200 is assembled, by insertion of the connector plug 30 into the connector socket 40 to provide a sealed connection between each panel assembly and the adjacent panel assembly or the corner connector 60. In one example, the plug seal, which may be a bulb seal, may be installed along the socket channel, and compressed by insertion of the connector plug 30 into the socket channel, to provide additional sealing of the joints between the wall panel assemblies, and to further prevent airflow through the joints for insulating and sealing purposes. Any of the components of the RWBS shelters 100 described herein may include sealing elements to, for example and without limitation, minimize incursion of water, allow removal of water via specific pathways, or minimize airflow through the components.

Each of the panel connectors 20 includes at least one retractable connector 64 positioned in the panel connector 20, as shown in FIG. 10, such that the wall panel connectors 20 connect to the bottom tracks 50 by engaging the retractable buttons 66 in the receiver apertures 58 of the bottom tracks 50, to form the wall assembly 200 of the shelter 100. As shown in FIGS. 1-4, the wall assembly 200, including the bottom tracks 50, the corner connectors 60, and wall panel assemblies (including panel connectors 20 and wall panels 10) form a rigid freestanding structure which can be used in this configuration without further modification.

For example, the freestanding wall assembly 200 can be used as an open top structure to house livestock or store supplies. In one example, a roof covering such as a tarp, netting, etc., or covering made of non-RWBS roofing materials, for example, locally sourced materials—including thatch, bamboo, wood, etc. —could be applied to cover the freestanding wall assemblies 200. In one example, the roof covering may be attached via tie downs or ropes connected to the wall assembly 200 via the connector slots 28. In a non-limiting example, a conventional roof, such as a wooden truss and shingle roof, can be installed to the wall assembly 200 to form a complete shelter. In the example shown in FIGS. 1-4, a roof assembly 300 is installed to the wall assembly 200, using steps of the example method 500 shown in FIGS. 5A-5C.

Step 524: Connect Gable Tracks. At step 524, gable tracks 80 are attached to the upper ends of the panel connectors 20 and corner connectors 60 of the wall assembly 200. As shown in FIG. 20A, each gable track 80 includes a first panel channel 92, or wall panel channel, for receiving an upper edge of a panel assembly, such as the wall panel assembly, and a second panel channel 94, or gable panel channel, for receiving a lower edge, such as the gable panel assembly, of a panel assembly.

Each of the first panel channels 92 and second panel channels 94 include receiver apertures 58 formed therethrough and positioned to receive and engage the retractable buttons 66 of the retractable connectors 64 of the panel connectors 20 and corner connectors 60 inserted into the channels. One or more seals, such as bulb seals, may be incorporated into any channel of the gable track 80. In particular, the second panel channel 94 may have seals, such that liquid is prevented from entering the second panel channel 94.

In some configurations, the modular shelter 100 may have more than one floor, such that the gable tracks 80 may be used for assembling an upper wall assembly 200 to a lower wall assembly 200, as would be recognized by skilled artisans. The gable tracks 80 are installed to the upper edges of the wall panels 10 and corner connectors 60 forming the lower wall assembly 200, and the second panel channels 94 of the gable tracks 80 function as the bottom track channels to receive and connect to the corner connectors 60 and the panel connectors 20 of the upper wall assembly 200, and to receive and connect to the lower edges of the wall panels 10 forming the upper wall assembly 200.

Figure 20C:
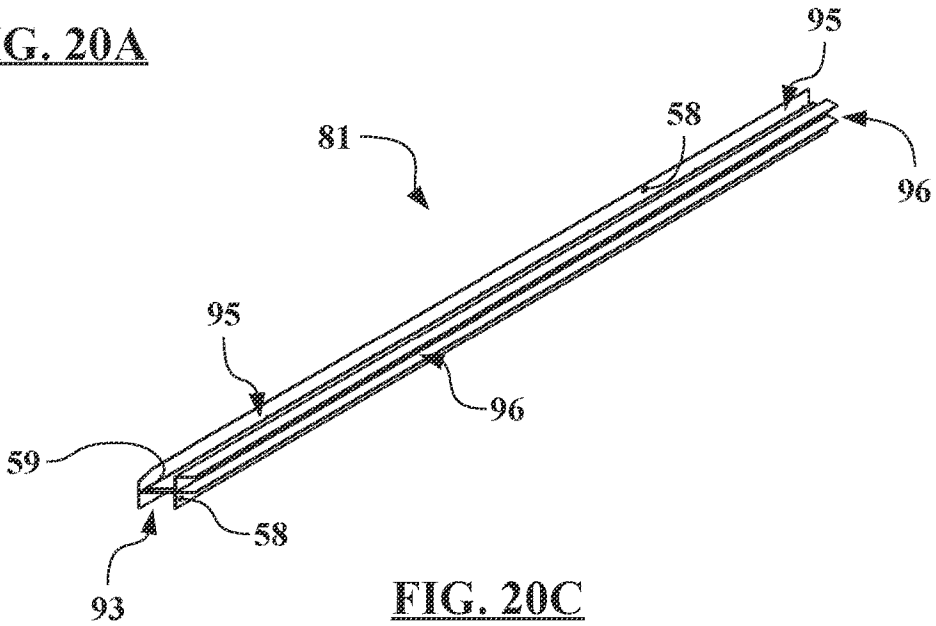
FIG. 20C schematically shows an isometric view of the alternative gable track.
Figure 20B:
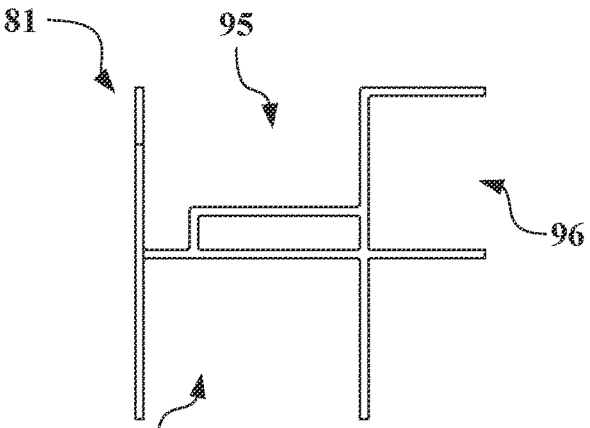
FIG. 20B schematically shows an end view of an alternative gable track.

As shown in FIG. 20B and FIG. 20C, the alternative gable track 81 includes a first panel channel 93 and a second panel channels 95. Further, the alternative gable track 81 includes an additional channel 96, which may be used to connect numerous additional elements. The additional channel 96 may be used for example, and without limitation, to connect support members for a floor in two-story shelters 100, or for attachment of additional components/elements for the shelter 100. The alternative gable track 81 also includes an offset portion and gutter portion, similar to the features of the alternative bottom track 51.

The gable track 80, or the gable track 81, may include a plurality of weep holes 59 extending through any wall of the gable track 80, or between the first panel channels 92 and second panel channels 94, to provide drainage of fluid, including rainwater, which may run off the upper wall assembly 200 and collect in the second panel channel 94, functioning as previously described for the weep holes 59 of the bottom tracks 50. Therefore, if water enters the gable track 80 or the gable track 81, such as by passing the optional seals, it is allowed to drain therefrom. The gable track 80 may be formed, without limitation, of similar materials, or by similar production methods, as the bottom tracks 50, the panel connectors 20, or the corner connectors 60.

Optional Step 526: Install Upper Wall Assembly. At step 526, the corner connectors 60, panel connectors 20, and wall panels 10 of an upper wall assembly 200 are installed to the second panel channel 94 of the gable track 80. This may include installing panels with doors 112 and/or windows 114. The wall structure including the lower wall assemblies 200 and upper wall assemblies 200 form a rigid, freestanding structure of increased height, which may be useful, for example, for the storage of supplies and/or equipment which exceeds the height of the lower wall assembly 200. As described previously, the freestanding structure including upper and lower wall assemblies 200 can be used as an open top structure. Alternatively, any of the roof structures previously discussed can be installed to the upper wall assembly 200.

Optional Step 528: Install Floor or Floor Assembly. Referring again to the method 500, at step 528 floor joists and a floor can be installed to the example shelter 100 to separate the upper and lower wall assemblies 200 and provide a second story interior space within the shelter 100. In a non-limiting example, the floor joists can be configured as cross members attached via brackets to the gable tracks 80. The descriptor "floor joist" is non-limiting, and it would be understood that the many cross members could also be used, for example, to install and/or attach a ceiling above the first floor of the shelter 100.

Note that the example method 500 is non-limiting, such that it would be understood that steps could be repeated to assemble a plurality of wall assemblies 200 stacked and connected via gable tracks 80 to construct shelters 100 of additional height and/or multiple floors.

Optional Step 530: Install Upper Level Access. At step 530 some sort of access to the upper floor may be installed. For example, and without limitation, stairs, a ladder, or an opening in the interior floor, may be installed to grant access to the upper level. Skilled artisans will recognize numerous configurations for access to the upper level.

Figure 13:
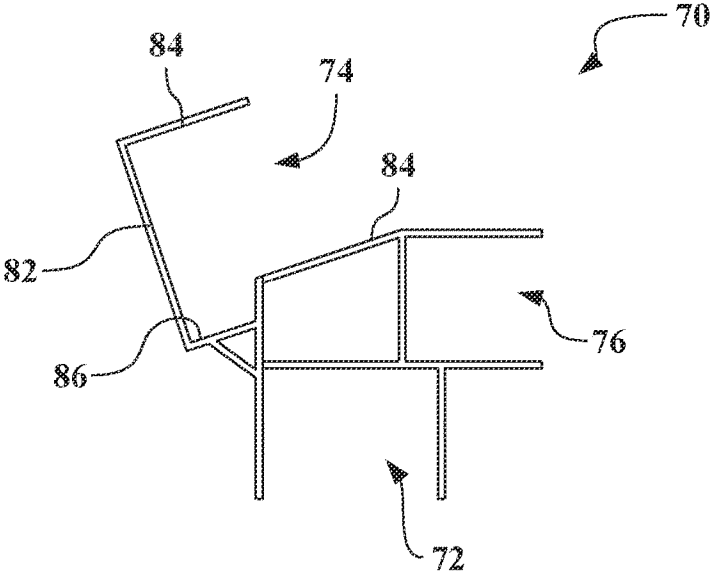
FIG. 13 schematically shows an end view of an eave track for connecting a roof assembly to a wall assembly.
Figure 14:
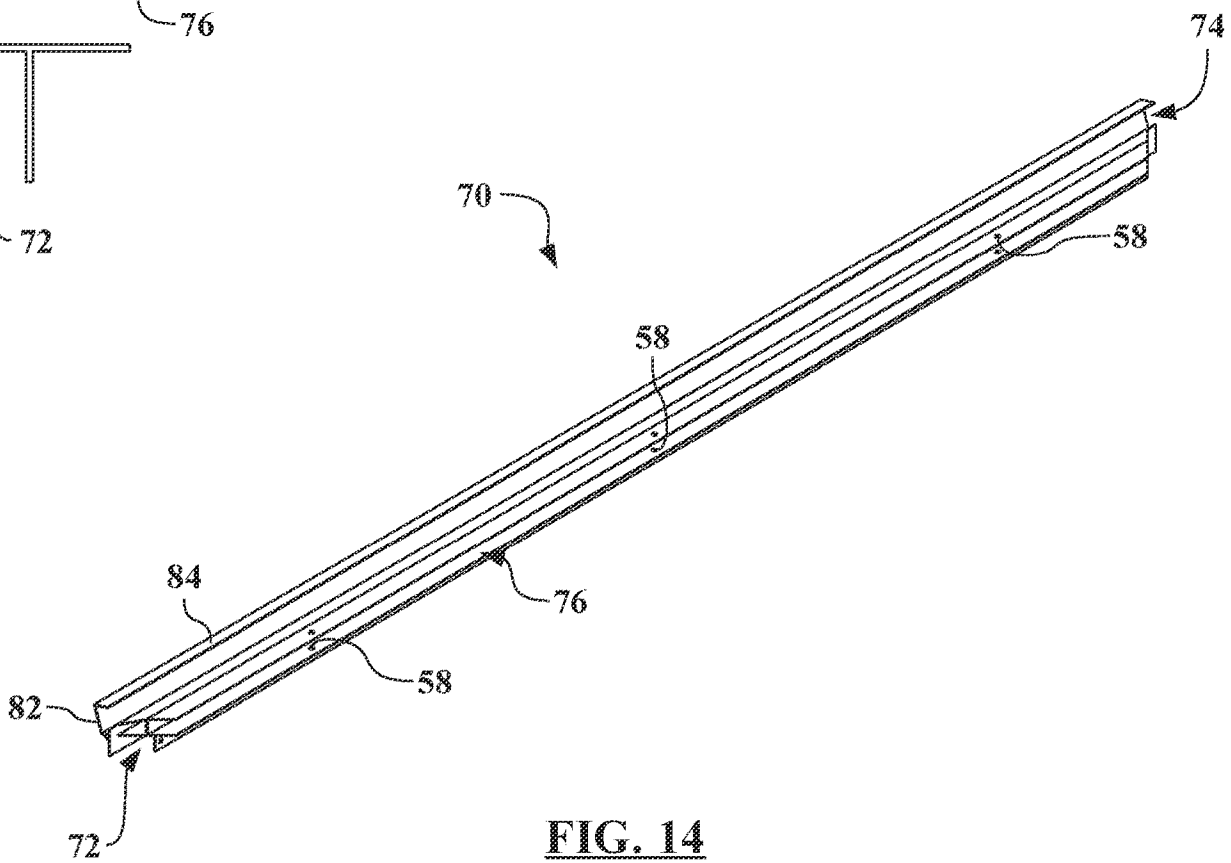
FIG. 14 schematically shows an isometric view of the eave track.

Step 532: Connect Eave Tracks. At step 532, the RWBS roof assembly 300 begins to be installed to the wall assemblies 200. Referring to the method 500, one or more eave tracks 70 are attached to the upper ends of the panel connectors 20 and the corner connectors 60 of the eave sides of the wall assembly 200. The term "eave side" is used to denote a side of the wall assembly 200 which joins with a lower edge of the roof panel 12. The eave tracks 70 are illustrated in FIGS. 13 and 14, and the connection between the wall panel 10, roof panel 12, and the eave track 70 is illustrated in FIGS. 4 and 19.

FIG. 19 illustrates an end view of the roof panel 12 inserted into the eave track 70 connected to the wall panel 10 on an eave side of the wall assembly 200. The eave track 70 is configured as shown in FIGS. 13 and 14, each of the eave tracks 70 being attached by engagement of the retractable buttons 66 of the wall assembly 200 corner connectors 60 and panel connectors 20 in receiver apertures 58 formed in the eave tracks 70, as best viewed in FIG. 14. As shown in FIGS. 13 and 14, each eave track 70 includes a wall panel channel 72 for receiving an upper edge of the wall panel 10 and a roof panel channel 74 for receiving a lower edge of the roof panel 12. The wall panel channel 72 includes receiver apertures 58 formed therethrough and positioned to receive and engage the retractable buttons 66 of the retractable connectors 64 of the panel connectors 20 and corner connectors 60 of the wall panels 10 inserted into the wall panel channel 72.

The roof panel channel 74 of the eave track 70 includes an offset fascia leg 82 and two soffit legs 84, which cooperate to receive the lower end of the roof panel 12. As shown in FIG. 19, the fascia leg 82 and soffit legs 84 interface respectively with the roof panel 12 to define a pitch angle PA of the roof panel 12. The fascia leg 82 can also be referred to herein as the roof pitch datum leg, or pitch datum leg. The soffit legs 84 can also be referred to herein as the roof panel support legs, or support legs.

The eave track 70 may include additional fastener apertures formed in the soffit legs 84 and distributed along the length of the eave track 70. These faster apertures may be positioned to align with the connector slots 28 of roof panel connectors 20. During assembly of the roof assembly 300 to the wall assembly 200, as illustrated by the non-limiting examples described herein, a T-bolt may be positioned in the connector slot 28 of the roof panel connector 20 such that the threaded end of the T-bolt is received by and extends through the fastener aperture of the lower soffit leg 84 of the eave track 70. A knob of the T-bolt fastener may be threaded onto the threaded end of the T-bolt and tightened to connect the panel connectors 20 and/or the roof panel 12 to the eave track 70. The knob can also be referred to herein as a T-bolt handle.

As shown in FIGS. 19 and 20, the lower edge of the roof panel 12 abuts and interfaces with the pitch fascia leg 82 between the soffit legs 84. The eave track 70 may have a plurality of weep holes formed therein, functioning as previously described for the weep holes of the bottom tracks 50, particularly at the lowest portion of a fascia recession 86, such that water, such as rainwater, flowing off the roof assembly 300 and into the eave track 70 is drained through the fascia recession 86. The eave tracks 70 may be formed, without limitation, of similar materials, or by similar production methods, as the bottom tracks 50, the panel connectors 20, the corner connectors 60, or the gable tracks 80.

Additionally, some configurations of the roof assembly 300 may include an eave seal (not shown) positioned, most likely, on the lower soffit leg 84 along the length of the eave track 70, in contact with the interior panel faces of the roof panels 12. Other eave seals may be incorporated. In one example, the eave seal is made of an elastomer, polymer, or rubber-based material which is compressible such that the eave seal is compressed during assembly of the roof panel 12 to the eave track 70, thus creating a continuous seal along the length of the eave track 70 between the surface of the soffit leg 84 and the interior panel face. In the event that water collects in the roof panel channel 74 at a rate or in a quantity that is not gravity drained through weep holes, then the eave seal may seal the flange to the roof panel interface and prevent water ingression along the lower soffit leg 84 to the interior of the shelter 100.

If water is present in sufficient quantity, the eave seal may pressurize the collected water to force the water out of the roof panel channel 74 via the weep holes. Non-limiting example configurations of the eave seal include bulb seals, D-shaped seals, O-ring seals, etc., to provide a seal the joint between the abutting connector portions 26. In one example, the eave track 70 may be provided with the eave seal pre-applied to the lower soffit leg 84. In another example, the eave track 70 and eave seal are provided as separate components and the eave seal is attached to the lower soffit leg 84 during assembly of the shelter 100. In a non-limiting example, the eave seal can be adhered to the lower soffit leg 84 by an adhesive or other fastening means, and/or the eave seal can include an adhesive strip for adhering the eave seal to the lower soffit leg 84.

Step 534: Assemble Gables. At step 534, the RWBS roof assembly 300 assembles the gable portions from, at least, gable panels 14 and gable panel connectors 20. The gable tracks 80 may have already been attached to the wall panel 10 and the wall panel connectors 20 and the corner connectors 60 along the gable sides of the wall assembly 200, with the gable tracks 80 being attached by engagement of the retractable buttons 66 in the receiver apertures 58 of the gable tracks 80.

At step 534, gable panel connectors 20 are attached to gable panel 14 to form gable panel assemblies, as shown in FIGS. 1, 2, and 4, similarly to the description for the assembly of wall panels 10 at step 520. In a non-limiting example, the gable panel 14, which is illustrated in the figures as two, triangular panels can be provided as a unitary gable panel 14, as an option, for example, where the size of the gable is smaller such that the gable panel 14 can be fabricated and transported as a unitary component. Furthermore, without limitation, the gable panel 14 can include one or more windows 114, panel frames and/or panel inserts, such as a transparent panels or screens, for providing light and/or ventilation to the shelter 100.

The gable panels 14 may be inserted to the second panel channel 94 (the upper channel) of the gable track 80 to form the gable assembly, in the example shown in FIGS. 1 and 2, at each gable end of the shelter 100. Gable panels 14, including the panel connectors 20, are connected via the retractable buttons 66 engaging the receiver apertures 58 in the gable track 80. The gable panel connectors 20 are substantially identical to the wall panel connectors 20 but are likely shorter and may have an angle cut into the upper portion.

Note that alternative gable constructions may be used. For example, and without limitation, the roof assembly 300 may have a single span along a single pitch angle PA, such that the gable panels 14 are substantially right triangles, which may be single, solid panels. This may also include one side having an upper layer, likely shorter, wall assembly 200 attached to an additional gable track 80.

Step 536: Assemble Roof Panels. At step 536, roof panel connectors 20 are attached to the roof panels 12 to form roof assemblies 300, as shown in FIGS. 1 and 3. The view of FIG. 1 may be considered as either one roof assembly 300 or two roof assemblies 300. The connection and assembly process may be like similar to that previously described for the assembly of wall panels 10 to the panel connectors 20 at step 520. The panel connectors 20 are attached to the roof panels 12 and then connected, similar to the view shown in FIG. 10, but without the bottom track 50 and, possibly, without the retractable connectors 64, such that the roof assembly 300 is held together by the gable end track 120, depending on the requirements of the roof assembly 300.

Step 538: Gable End Closures. At step 538, the gable end track 120 is attached to the gable panels 14, by insertion of the upper edge of the gable panel 14 into a gable panel channel of the gable end track 120, which may also be referred to herein as the gable closure. The gable end track 120 generally includes two channel slots, a gable channel slot and a roof channel slot, at substantially right angles to one another.

The gable end track 120, which is best viewed in FIGS. 1-3, encloses the upper edge of the gable panel 14, and receives one or more roof panels 12. The gable end tracks 120 may be formed, without limitation, of similar materials, or by similar production methods, as the bottom tracks 50, the panel connectors 20, the corner connectors 60, the gable tracks 80, or the eave tracks 70.

Step 540: Connect Cross Members. In step 540, one or more cross members 130 can be connected the eave tracks 70, to provide additional rigidity to the wall assembly 200, truss support for the roof assembly 300, or both. The cross member 130, and elements connected thereto, are best viewed in FIGS. 4 and 18. Note that in some configurations, the modular shelter 100 may be constructed without the cross members 130, such that step 540 may be optional but many configurations will include some truss or cross support.

In a non-limiting example, the eave tracks 70 include a cross channel 76 having receiver apertures 58 defined therein, as best viewed in FIG. 14. Therefore, the cross channel 76 receives the cross members 130 via, for example, the retractable buttons 66 of retractable connectors 64 engaging the receiver apertures 58.

The cross member 130 can include a web member 132 operatively connected to the cross member 130 and functional as a truss element to support portions of a ridge track 110 or ridge track assembly 110 (shown in FIGS. 15-18) into which the upper edges of the roof panels 12 are received at a height corresponding to the roof pitch angle. The web member 132 may be fixedly attached to the cross member 130, for example, by welding, bracketing, or other fixed fastening method, such that the ridge track assembly 110 rests on, e.g., is supported by, the uppermost end of the web member 132.

Figure 18:
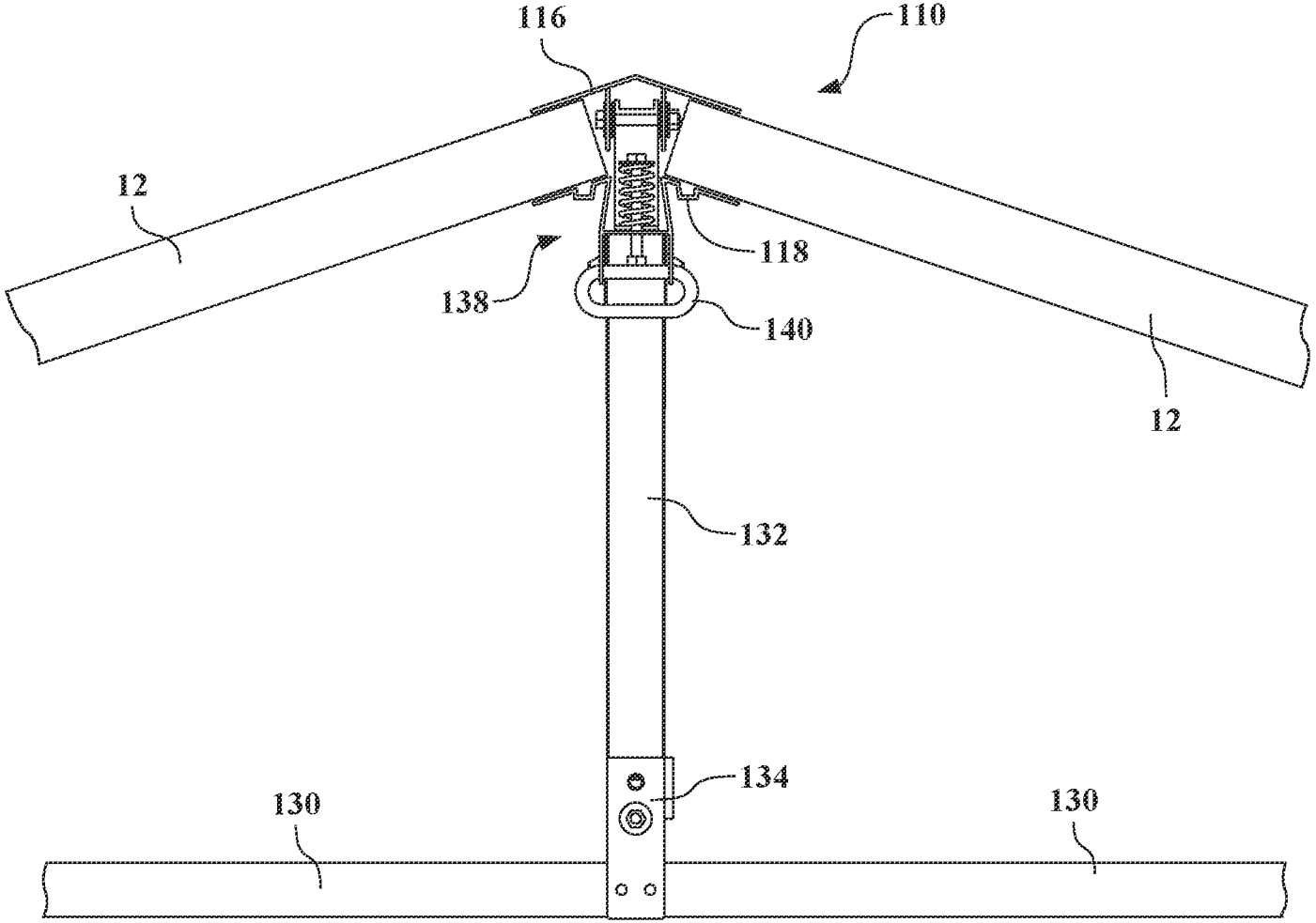
FIG. 18 schematically shows an end view of the ridge assembly held together by a locking connector assembly (LCA), along with a cross member, web member, and two roof panels.

As shown in FIGS. 4 and 18, the web member 132 can be hingedly attached to the cross member 130, such that the web member 132 can be rotated via a hinge bracket 134 from a folded position, or stowed position, where the web member 132 is adjacent to the cross member 130. The web member 132 may then be rotated to an upright position, or deployed position, as shown in FIGS. 4 and 18.

The web member 132 can be positioned in the folded position, adjacent to the cross member 130, for efficiency of packaging and shipment, such that the cross members 130 with the web members 132 in the folded position can be more closely nested to each other during transport. The upper end of the web member 132 includes one or more retractable connectors 64 and retractable buttons 66, which can be engaged with receiver apertures 58 of the ridge track assembly 110, to connect the web member 132 to the ridge track assembly 110 in a truss configuration, as shown in FIGS. 4 and 18.

Figure 15:
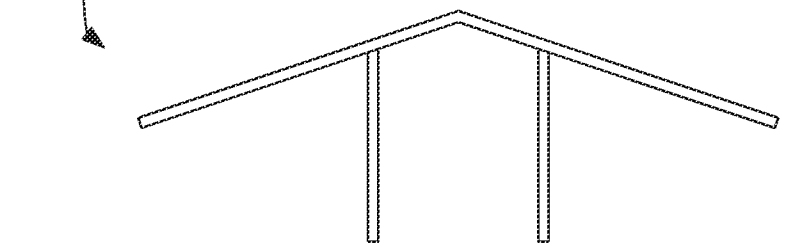
FIG. 15 schematically shows an end view of an upper portion of a two-piece ridge track assembly, which may be referred to as a ridge cap.
Figure 16B:
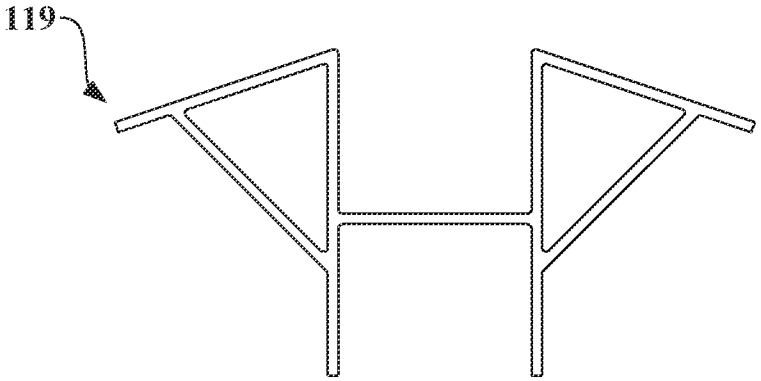
FIG. 16B schematically shows an end view of an alternative lower portion of the two-piece ridge track assembly, which may be referred to as an alternative ridge tray.
Figure 16A:
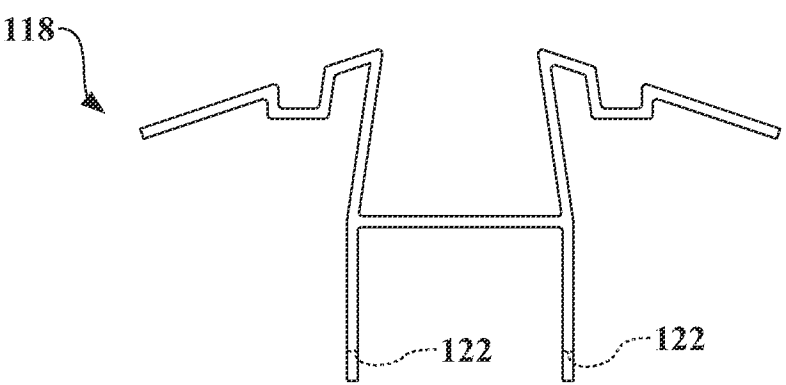
FIG. 16A schematically shows an end view of a lower portion of the two-piece ridge track assembly, which may be referred to as a ridge tray.
Figure 17:
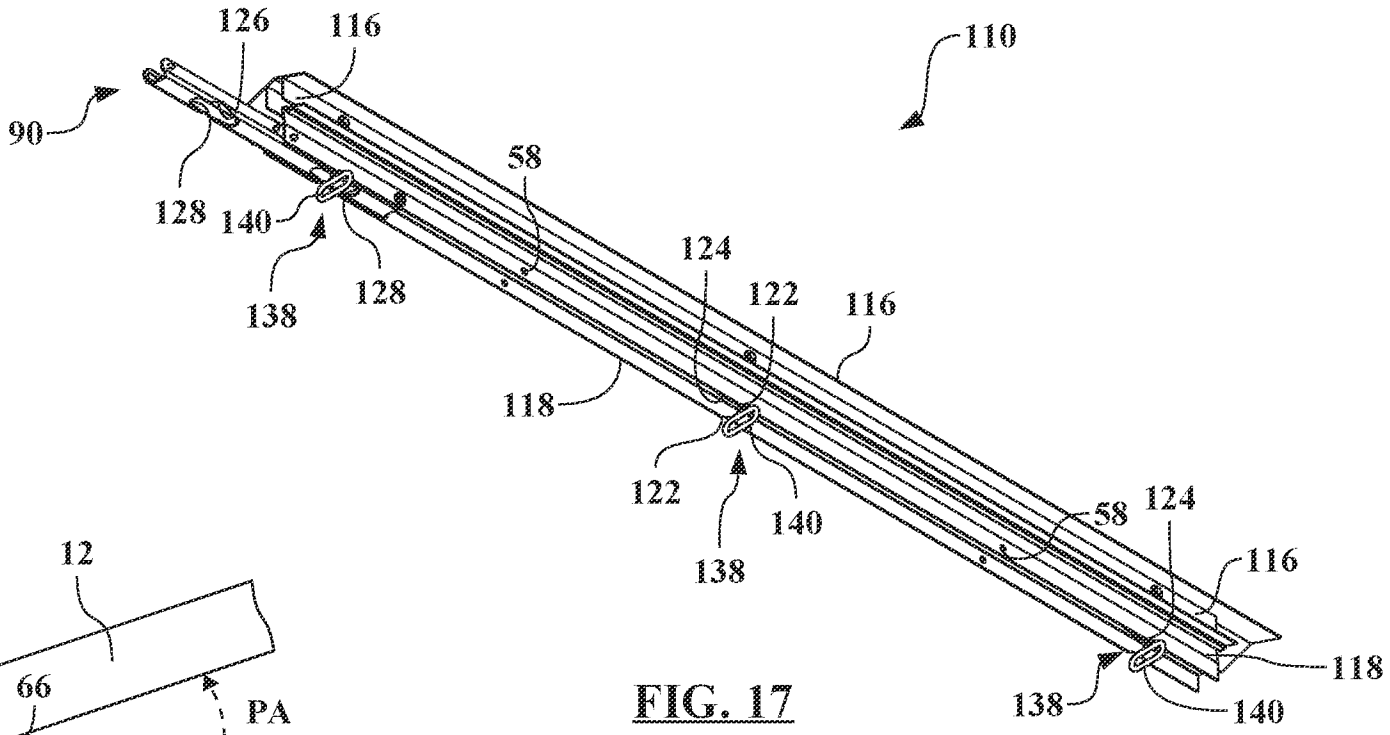
FIG. 17 schematically shows a bottom isometric view of the two-piece ridge track assembly and with a ridge splice for connecting to adjacent ridge track assemblies.

Step 542: Assemble Ridge Track Portions. At step 542 of the method 500, portions of the ridge track assembly 110 are assembled. As shown in FIGS. 15-18, the ridge track assembly 110 includes two track portions, an upper track 116 and a lower track 118, held together by spring-loaded locking connector assemblies (LCA) 138. FIG. 15 shows a side view of the upper track 116, which may be referred to as a ridge cap: FIG. 16A shows a side view of the lower track 118, which may be referred to as a ridge tray: FIG. 16B shows a side view of an alternative lower track 119, which may be referred to as an alternative ridge tray: FIG. 17 shows an isometric view of the assembled ridge track assembly 110; and FIG. 18 shows the assembled ridge track assembly 110 with the LCA 138 having a cover panel removed to illustrate the spring within.

Assembly of the ridge track assembly 110 may occur in various orders, and the order suggested herein is only one example, as are the remainder of the steps of the method 500. After the cross members 130 are installed and the web members 132 rotated upward, the lower track 118 may be attached to the web members 132 via retractable connectors 64 and retractable buttons 66 engaged with receiver apertures 58 in a web channel of the lower track 118. The elements of the ridge track assembly 110, including the upper tracks 116 and the lower tracks 118, may be formed, without limitation, of similar materials, or by similar production methods, as the bottom tracks 50, the panel connectors 20, the corner connectors 60, the gable tracks 80, or the eave tracks 70, and other components of the shelter 100. In some configurations, there may be seals, for example bulb seals, between the upper track 116 and the roof panels 12.

In some configurations, multiple lower tracks 118 will be aligned and connected via at least one ridge splice 90, as viewed in FIG. 17. The ridge splice 90 may be stored within the web channel of the lower track 118 and then rotated outward to slot within, and attach to, the web channel of the adjacent lower track 118. The ridge splices 90 may be attached to the lower tracks 118 via retractable connectors 64 and retractable buttons 66 engaged with receiver apertures 58 of formed in the web channels.

Additional fasteners may be used for transportation, assembly, or both, of any of the components of the modular shelter 100. For example, and without limitation, the ridge splice 90 may pivot about a bolt or pivot pin, which may later be removed, or may be retained within the assembled shelter 100.

FIG. 16B illustrates the alternative lower track 119 or alternative ridge tray. The alternative lower track 119 includes buttress or support elements to strengthen the alternative lower track 119.

Step 544: Install Roof. At step 544 of the method 500, one or more roof panels 12, having panel connectors 20 connected to one or more edges, may be laid onto the assembled portions of the ridge track assembly 110. The installed lower tracks 118, supported by the web members 132, provide a base onto which roof panels 12 and roof panel connectors 20 may be laid during installation. Note that the roof panels 12 were assembled to the roof panel connectors 20 in step 536. However, the installation step 544 may also include assembling the roof panels.

The roof panels 12 may also be inserted into roof panel channels of the gable end tracks 120. Furthermore, the roof panels may be inserted to roof panel channels of the eave track 70. This allows the roof panels 12 and roof panel connectors 20—i.e., portions of the roof assembly 300—to be installed on top of the freestanding structure prior to installing the upper tracks 116 with the LCA 138.

Step 546: Complete Ridge Track. At step 546 of the method 500, the reminder of the ridge track assembly 110 is assembled. As best viewed in FIGS. 16-18, the lower tracks 118 include tray cutouts 122 or locking notches formed adjacent tray slots 124 or handle apertures. These elements are configured to cooperate with pull handles 140 of the LCA 138. The lower channels of the lower tracks 118 may be referred to as bracket channels. The alternative lower track 119 also includes similar tray cutouts 122.

To attach the upper track 116 to the lower track 118, the LCA 138 are attached to the upper track 116, such as with bolts or retractable connectors 64. Then, the pull handles 140, which are rotated substantially 90-degrees relative to the orientations shown in the figures, are pulled through the tray slots 124 in the lower track 118. After pulling through the tray slots 124, the pull handles 140 are rotated 90-degress, to the orientations shown in the figures, and released, such that the internal spring of the LCA 138 pulls the pull handles 140 into engagement with the tray cutouts 122.

The tray cutouts 122 may be difficult to view in FIG. 17, however, the splice 90 includes splice cutouts 126 that are similarly shaped to allow the pull handles 140 to lock when rotated. Similarly, the tray slots 124 may be difficult to view in FIG. 17, but the splice 90 includes splice slots 128 that are similarly shaped to allow the pull handles 140 to be pulled through before rotation.

The upper track 116 and the lower track 118 are squeezed by the LCA 138 onto the sides of the roof panels 12 therebetween, as best viewed in FIG. 18. Additionally, the spring of the LCA 138 holds the ridge splice 90 connecting to other sections of the ridge track assembly 110. In the example modular shelter 100 shown in FIG. 1, there are two ridge tracks 110 connected by one ridge splice 90 (not viewable in FIG. 1). Note that several LCA 138 and pull handles 140 may be used. In the view of FIG. 17, there are three LCA 138, such that for the modular shelter 100 shown in FIG. 1, there may be up to six LCA 138 used to connect the elements of the two ridge tracks 110.

Optional Step 550: Connect Interior Wall Sections. Optional steps 550-556 are provided to install or connect, including, but not limited to, interior components, exterior components, utilities, wall components, or combinations thereof. At step 550, interior wall sections may be attached, such as to the connector slots 28 of the panel connectors 20. Alternatively, any of the additional components may be attached via other mechanisms or means, including, without limitation, brackets attached to the wall panels 10, roof panels 12, gable panels 14, panel connectors 20, or corner connectors 60.

Other components can be installed to the shelter 100, including, without limitation, flooring, ceiling components, lighting, communication equipment, toilets, plumbing, kitchen equipment, and other components recognizable by those having ordinary skill in the art. Note that these components may not be illustrated in the figures, but will be understood skilled artisans.

Optional Step 552: Install Utilities. At step 552, one or more utilities may be installed to the shelter 100. The possible utilities include, without limitation, lighting, electrical wire and/or outlets, HVAC, and plumbing.

Optional Step 554: Connect Interior Components. At step 554, one or more interior components may be installed or connected to the shelter 100. The possible interior components include, without limitation, flooring, ceiling components, shelves, and hooks.

Optional Step 556: Connect Exterior Components. At step 556, one or more exterior components may be installed or connected to the shelter 100. The possible exterior components include, without limitation, air conditioning units, solar power units, and communications systems. The method 500 may end after optional step 556, or additional steps may be provided to further customize or better prepare the modular shelter 100 for the specific needs of specific installation.

The RWBS components described herein, with reference to the method 500 and the other figures, can be configured, combined, and assembled into multiple different configurations of modular shelters 100 for various uses, including recreational, utilitarian, humanitarian, military, and other uses recognizable to those having ordinary skill in the art. The various RWBS components described herein including wall panels 10, roof panels 12, panel connectors 20, corner connectors 60, bottom tracks 50, eave tracks 70, gable tracks 80, and ridge tracks 110, etc. can be adapted and/or modified within the scope of this disclosure for assembling shelters 100 for the various uses.

By way of non-limiting example, the various RWBS components can be modified as appropriate to the intended use of the shelter 100, including modifications to provide desired appearance or functional characteristics, including, without limitation: camouflage, decorative treatments, light reflective properties, ballistic properties, surface texturing and embossment, decorative trim, decal application, etc. as appropriate to the intended use and/or location of the modular shelter 100.

The example of the retractable connector 64 is illustrative and non-limiting, and it would be understood that the use of other types of reusable connectors, including spring-loaded or spring-type connectors or conventional removable and reusable connectors, such as bolts and nuts, etc., is anticipated within the scope of the disclosure. For permanent installations of the modular shelter 100, RWBS components with single use and/or non-reusable connectors, such as rivets, can be provided and are anticipated within the scope of the disclosure.

The Rapid Wall Building System (RWBS) described herein is further advantaged by logistic efficiencies, due to the ability to compactly package and ship the standardized components, many, or all, of which can be nested to each other to substantially reduce empty shipping space. Combined with the lightweight characteristics of the RWBS components, transportation costs and energy savings are significantly lower relative to transportation costs of conventional materials for similarly sized modular shelters 100.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. A lightweight modular shelter, comprising:

a first panel;

a first panel connector, having a panel edge channel operatively connected to a side of the first panel, and a connector plug and a connector socket;

a second panel; a second panel connector, having a panel edge channel operatively connected to a side of the second panel, and a connector plug and a connector socket;

a bottom track;

a third panel;

a third panel connector, having a panel edge channel operatively connected to a side of the third panel, and a connector plug and a connector socket;

a fourth panel;

a fourth panel connector, having a panel edge channel operatively connected to a side of the fourth panel, and a connector plug and a connector socket;

an eave track having a wall panel channel and a roof panel channel disposed at an angle to the wall panel channel;

a ridge cap;

a ridge tray;

a spring-loaded locking connector assembly configured to selectively join the ridge cap to the ridge tray;

wherein the connector plug of the first panel connector is inserted into the connector socket of the second panel connector, such that the first panel and the second panel are operatively connected;

wherein the first panel, the second panel, the first panel connector, and the second panel connector are mated to the bottom track;

wherein mating the first panel, the second panel, the first panel connector, and the second panel connector to the bottom track occurs via retractable connectors engaging receiver apertures formed in the bottom track;

wherein the first panel and the second panel are wall panels, and the third panel and the fourth panel are roof panels; wherein the wall panel channel of the eave track is mated to a top of the connected first panel and second panel;

wherein the connector plug of the third panel connector is inserted into the connector socket of the fourth panel connector, such that the third panel and the fourth panel are operatively connected;

wherein the roof panel channel of the eave track is mated to a bottom of the connected third panel and fourth panel, such that the third panel and the fourth panel are at an angle to the first panel and the second panel;

wherein mating the first panel, the second panel, the first panel connector, and the second panel connector to the eave track occurs via retractable connectors engaging receiver apertures formed in the eave track; and wherein, in a joined configuration, the third panel and the fourth panel are disposed between the ridge cap and the ridge tray and joined by the spring-loaded locking connector assembly.

2. The lightweight modular shelter of claim 1, further comprising:

a cross member;

wherein the eave track includes a cross channel substantially orthogonal to the wall panel channel; and wherein the cross member is mated to the cross channel.

3. The lightweight modular shelter of claim 2, further comprising:

a web member hingedly connected to the cross member, and movable between a stowed position, substantially adjacent to the cross member, and a deployed position, substantially orthogonal to the cross member; and wherein the web member is mated to the ridge tray.

4. The lightweight modular shelter of claim 3, wherein the web member is mated to the ridge tray via retractable connectors engaging receiver apertures formed in the ridge tray.

5. The lightweight modular shelter of claim 4, further comprising:

a plurality of corner connectors, each having two connector plugs and two connector sockets;

wherein the two connector plugs are substantially orthogonal to one another;

wherein the two connector sockets are substantially orthogonal to one another;

wherein the connector plugs and the connector sockets of the corner connectors are mateable to the connector plug and the connector socket of the first panel and the second panel; and wherein the corner connectors are mated to the bottom track.

6. The lightweight modular shelter of claim 5, further comprising:

a fifth panel;

a fifth panel connector, having a panel edge channel operatively connected to a side of the fifth panel, and a connector plug and a connector socket;

a sixth panel;

a sixth panel connector, having a panel edge channel operatively connected to a side of the sixth panel, and a connector plug and a connector socket;

a gable track having a wall panel channel and a gable panel channel;

two gable panels;

two gable panel connectors, each having a panel edge channel operatively connected to one side of the two gable panels, and a connector plug and a connector socket;

wherein the connector plug of one of the two gable panel connectors is inserted into the connector socket of the other of the two gable panel connectors, such that the two gable panels are operatively connected;

wherein the connector plug of the fifth panel connector is inserted into the connector socket of the sixth panel connector, such that the fifth panel and the sixth panel are operatively connected;

wherein the wall panel channel of the gable track is mated to a top of the connected fifth panel and sixth panel; and wherein the gable panel channel of the gable track is mated to a bottom of the connected two gable panels.

7. A lightweight modular shelter, comprising:

a plurality of wall panels;

a plurality of wall panel connectors, having a panel edge channel operatively connected to a side of the wall panels, and a connector plug and a connector socket opposite the panel edge channel;

a plurality of corner connectors, each having two connector plugs and two connector sockets, wherein the connector plugs and the connector sockets are substantially orthogonal to one another;

a plurality of bottom tracks;

a plurality of roof panels;

a plurality of roof panel connectors, having a roof panel edge channel operatively connected to a side of the roof panels, and a connector plug and a connector socket opposite the roof panel edge channel;

a plurality of eave tracks having a wall panel channel and a roof panel channel disposed at an angle to the wall panel channel;

a plurality of gable panels;

a plurality of gable panel connectors, having a gable panel edge channel operatively connected to a side of the gable panels, and a connector plug and a connector socket opposite the gable panel edge channel;

a plurality of gable tracks having a wall panel channel and a gable panel channel substantially aligned on opposite side of the gable tracks;

wherein the connector plug of one of the wall panel connectors is inserted into the connector socket of another wall panel connector, such that adjacent wall panels are operatively connected;

wherein the connector plugs of one of the corner connectors are inserted into the connector sockets of adjacent wall panel connectors, such that wall panels are operatively connected to the corner connectors;

wherein the connected wall panels and corner connectors are mated to the bottom tracks and the connected wall panels are mated to the bottom tracks to form a free-standing structure;

wherein the wall panel channels of the eave tracks are mated to a top of the wall panels, the wall panel connectors, and the corner connectors, opposite from the bottom tracks;

wherein the connector plug of one of the roof panel connectors is inserted into the connector socket of another roof panel connector, such that adjacent roof panels are operatively connected;

wherein the roof panel channels of the eave tracks are mated to a bottom of the roof panels and the roof panel connectors, such that the roof panels are at an angle to the wall panels;

wherein mating the wall panel connectors and the corner connectors to the bottom tracks occurs via retractable connectors engaging receiver apertures formed in the bottom tracks;

wherein mating the wall panel connectors and the corner connectors to the eave tracks occurs via retractable connectors engaging receiver apertures formed in the eave tracks;

wherein the wall panel channels of gable tracks are mated to a top of the wall panels, the wall panel connectors, and the corner connectors, opposite from the bottom tracks;

wherein the connector plug of one of the gable panel connectors is inserted into the connector socket of another gable panel connector, such that adjacent gable panels are operatively connected; and wherein the gable panel channels of the gable tracks are mated to a bottom of the gable panels and the gable panel connectors, such that the gable panels are substantially aligned with the wall panels.

8. The lightweight modular shelter of claim 7, wherein mating the gable panel connectors to the gable tracks occurs via retractable connectors engaging receiver apertures formed in the gable tracks.

9. The lightweight modular shelter of claim 8, further comprising:

a plurality of cross members;

a plurality of web members hingedly connected to the cross member, and movable between a stowed position, substantially adjacent to the cross member, and a deployed position, substantially orthogonal to the cross member; and wherein the eave tracks include cross channels substantially orthogonal to the wall panel channels; and wherein the cross members are mated to the cross channels of the eave tracks.

10. The lightweight modular shelter of claim 9, further comprising:

at least one ridge cap;

at least one ridge tray;

a plurality of spring-loaded locking connector assemblies configured to selectively join the ridge caps to the ridge trays;

wherein upper edges of the roof panels are disposed between the ridge cap and the ridge tray when joined by the spring-loaded locking connector assemblies; and wherein the web members are mated to the ridge tray via retractable connectors engaging receiver apertures formed in the ridge tray.

11. The lightweight modular shelter of claim 10, further comprising:

a splice, wherein the splice is configured to connect one ridge tray to another ridge tray.

12. The lightweight modular shelter of claim 11, wherein one of the wall panels includes a door; and wherein one of the wall panels includes a window.

13. A method of assembling a modular shelter, comprising:

providing the lightweight modular shelter of claim 7;

laying a plurality of bottom tracks on a substantially flat surface;

connecting a plurality of wall panel connectors to a plurality of wall panels via panel edge channels in the wall panel connectors;

connecting a plurality of corner connectors to the bottom tracks;

connecting the wall panel connectors and the plurality of wall panels to the bottom tracks;

connecting adjacent wall panel connectors by inserting a connector plug of one wall panel connector into a connector socket of another wall panel connector;

connecting wall panel connectors to one of the corner connectors by inserting the connector plug of one wall panel connector into a connector socket of the corner connector and by inserting a connector plug of the corner connector into the connector socket of another wall panel connector such that the wall panels, the wall panel connectors, the corner connectors, and the bottom tracks form a freestanding structure having at least four wall assemblies;

connecting a plurality of eave tracks onto a top edge of two of the wall assemblies;

connecting a plurality of roof panels to the eave tracks at an angle to the wall assemblies;

connecting a plurality of gable tracks onto a top edge of two of the wall assemblies via wall panel channels of the gable tracks; and connecting a plurality of gable panels onto an opposite side of the gable tracks via gable panel channels of the gable tracks.

14. The method of assembling the modular shelter of claim 13, further comprising:

supporting a top edge of the roof panels with one or more ridge trays;

tying one or more ridge caps to the ridge trays with a plurality of spring-loaded locking connector assemblies, such that the roof panels are partially between the ridge caps to the ridge trays.

15. The method of assembling the modular shelter of claim 14, further comprising:

connecting a plurality of cross members to the eave tracks;

deploying a plurality of web members hingedly attached to the cross members; and connecting the web members to the ridge trays.

16. The method of assembling the modular shelter of claim 15, further comprising:

wherein connecting the corner connectors and the wall panel connectors to the bottom tracks occurs via retractable connectors engaging receiver apertures formed in the bottom tracks; and wherein connecting the corner connectors and the wall panel connectors to the eave tracks occurs via retractable connectors engaging receiver apertures formed in the eave tracks.

* * * * *